US007231876B2

(12) United States Patent
Kellner

(10) Patent No.: US 7,231,876 B2
(45) Date of Patent: Jun. 19, 2007

(54) PROJECTILES POSSESSING HIGH PENETRATION AND LATERAL EFFECT WITH INTEGRATED DISINTEGRATION ARRANGEMENT

(75) Inventor: Gerd Kellner, Schramberg (DE)

(73) Assignee: Rheinmetall Waffe Munition GmbH, Ratingen (DE)

( * ) Notice: Subject to any disclaimer, the term of this patent is extended or adjusted under 35 U.S.C. 154(b) by 0 days.

(21) Appl. No.: 10/305,512

(22) Filed: Nov. 27, 2002

(65) Prior Publication Data

US 2003/0167956 A1 Sep. 11, 2003

(51) Int. Cl.
*F42B 12/00* (2006.01)

(52) U.S. Cl. ..... 102/517; 102/506; 102/501; 102/491; 102/494

(58) Field of Classification Search ..... 102/517, 102/516, 506, 501, 491, 494
See application file for complete search history.

(56) References Cited

U.S. PATENT DOCUMENTS

| | | | | | |
|---|---|---|---|---|---|
| 1,290,001 | A | * | 12/1918 | Zaikowsky | 102/496 |
| 3,489,088 | A | * | 1/1970 | Von Ballmoos et al. | 102/496 |
| 4,211,169 | A | * | 7/1980 | Brothers | 102/494 |
| 4,625,650 | A | | 12/1986 | Bilsbury | |
| 4,913,054 | A | * | 4/1990 | Petersen | 102/439 |
| 4,970,960 | A | | 11/1990 | Feldmann | |
| 5,243,916 | A | * | 9/1993 | Freche et al. | 102/481 |
| 5,535,679 | A | * | 7/1996 | Craddock | 102/494 |
| 6,598,534 | B2 | * | 7/2003 | Lloyd et al. | 102/494 |
| 6,659,013 | B1 | | 12/2003 | Kellner | |
| 6,772,695 | B2 | | 8/2004 | Kellner | |
| 6,772,696 | B2 | * | 8/2004 | Kellner | 102/516 |
| 6,789,484 | B2 | | 9/2004 | Kellner | |

FOREIGN PATENT DOCUMENTS

| | | | |
|---|---|---|---|
| DE | 32 40 310 C | | 10/1982 |
| DE | 197 00 349 C | | 1/1997 |
| EP | 0 338 874 | * | 1/1994 |
| EP | 0 718 590 | * | 6/1996 |
| FR | A-1201290 | | 12/1959 |
| WO | WO 03/046470 | * | 6/2003 |

* cited by examiner

*Primary Examiner*—Michelle Clement
(74) *Attorney, Agent, or Firm*—McGrath, Geissler, Olds & Richardson, PLLC

(57) ABSTRACT

A highly effective and also inert active penetrator, an active projectile, an active airborne body or an active multipurpose projectile with a constructively adjustable or settable relationship between penetrating power and lateral effect. The end ballistic total effect which is obtained from the penetrating depth and covering the surface or stressing of the surface is initiated in an active case by means of a releasable arrangement or installation which is independent of the position of the active body.

38 Claims, 25 Drawing Sheets

Fig. 6A
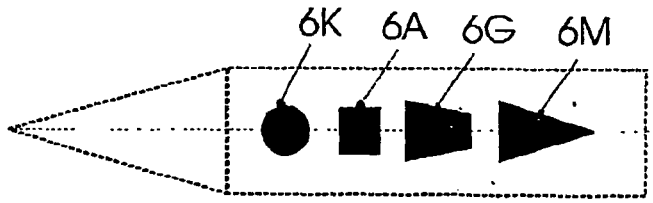
Fig. 6B
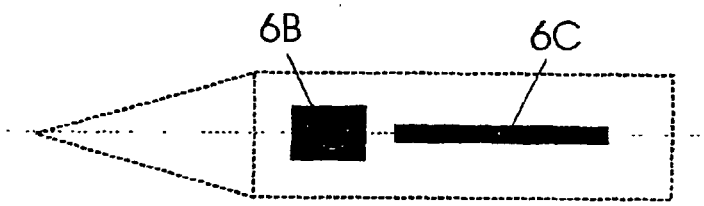
Fig. 6C
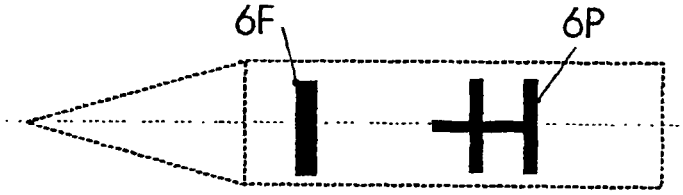
Fig. 6D
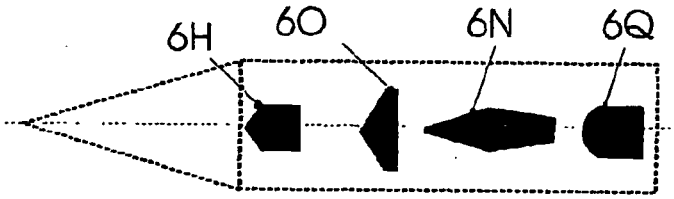
Fig. 6E
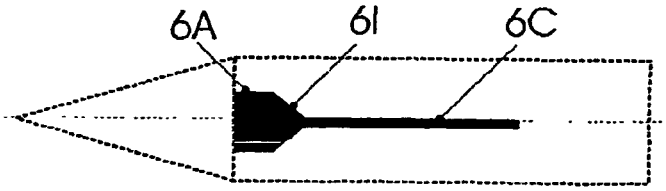
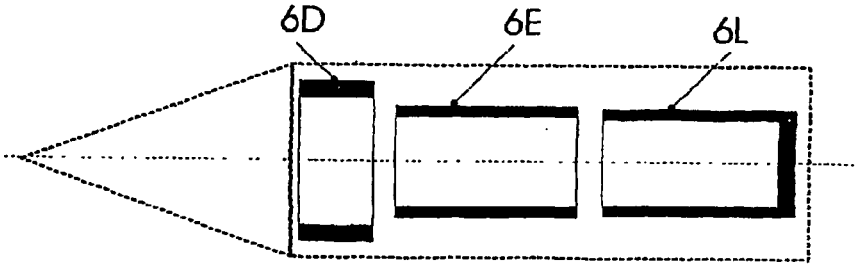
Fig. 7

14
18D
20B
19C
18C
19B
20A
17C
18B
19A
20A
17B
18A
19A
20A
17A 18A
19A
20A
17A 21B
21A
15
15A
18C
20A
19A
17B
18B
19A
20A
17B
18A
19A
20A
17A 22B
16
22A
19A
18A
19A
20A
17A
18A
19A
20A
17A

Fig. 40A
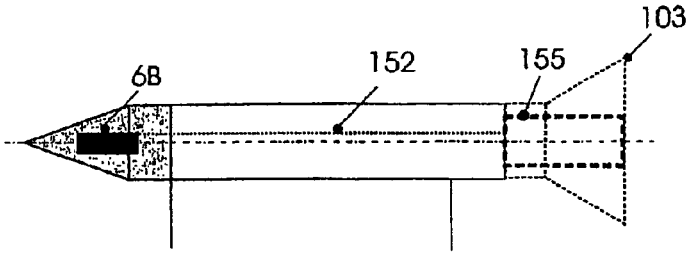
Fig. 40B
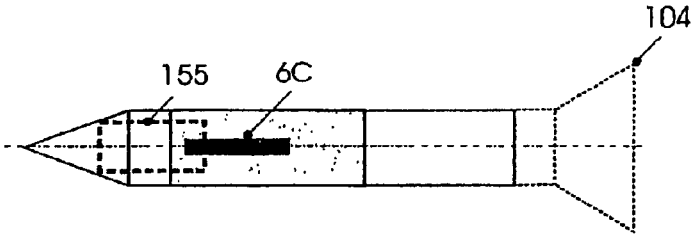
Fig. 40C
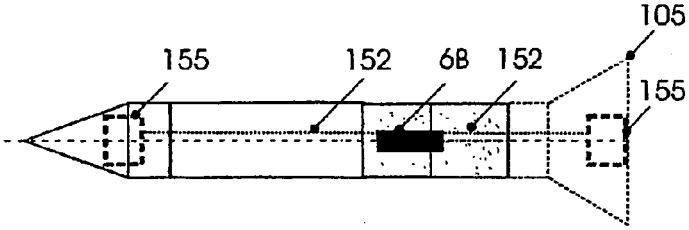
Fig. 40D
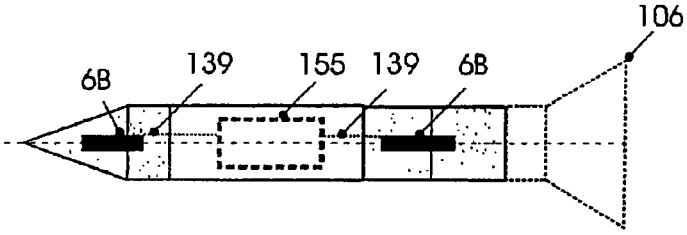
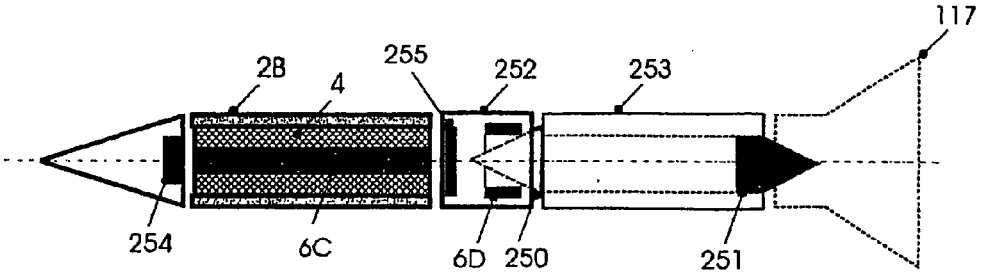
Fig. 41

PROJECTILES POSSESSING HIGH PENETRATION AND LATERAL EFFECT WITH INTEGRATED DISINTEGRATION ARRANGEMENT

BACKGROUND OF THE INVENTION

1. Field of the Invention

The present invention relates to a highly effective and also inert active penetrator, an active projectile, an active airborne body or an active multipurpose projectile with a constructively adjustable or settable relationship between penetrating power and lateral effect. The end ballistic total effect which is obtained from the penetrating depth and covering the surface or stressing of the surface is initiated in an active case by means of a releasable arrangement or installation which is independent of the position of the active body. This is achieved through the intermediary of a suitably inert transfer medium; for example, such as a liquid, a pasty medium, a plastic material, a material which is constituted of a combination of a plurality of components or a plastically deformable metal, within which, by means of pressure generating and/or detonative arrangement (also without any primary explosives) there is built-up with an integrated or functionally specified triggering initiation with integrated detonating safety a quasi-hydrostatic or, respectively, hydrodynamic pressure field, and which is transmitted to the surrounding, fragment forming or sub-projectile emitting casing.

For end ballistically active effective carriers, one usually distinguishes between:

Inertial projectiles (KE projectiles, spin or aerodynamically stabilized arrow or slender projectiles);

Hollow charges (HL projectiles, flat conical charges, preferably aerodynamically stabilized) with a triggering device;

Explosive projectiles with triggering device;

Inert fragmentation projectiles, for example, PELE (penetrator with increased lateral effects) or with disintegration charge possessing a triggering device;

So called multipurpose projectiles/hybrid projectiles (explosive and/or fragmentation effect with; for example, HL effect acting radially or in the direction of flight (ahead);

Tandem projectiles (KE, HL or combined);

Warheads (mostly with HL and/or fragmentation/explosive effect); and

Penetrators or sub-penetrators in airborne bodies or warheads.

Furthermore, for a series of the above-mentioned active body types there are available corresponding special constructions. These unfold as a rule, certain, constructively or technologically (material-type) specified effects. An effectively optimized configuration is however, mostly connected with a serious limitation in the effective range. In order to correspond with the requirements of a combat area, one mostly reaches back to a combination of a plurality of (two or three) separate effective carriers (for example separately supplied ammunition, mixed ammunition belts, and so forth). In a simplified manner, one combines; for example, inertial projectiles (KE effect) with explosive and fragmentation projectiles.

The simplification of the ammunition palette without any restriction in the effective spectrum is thus a constantly sought after path for a solution. In the area of inertial projectiles there is achieved a decisive advance by means of the laterally acting penetrators (PELE penetrators). Such types of PELE penetrators are disclosed; for example, in German Patent Publication DE 197 00 349 C1. This effective or active carrier combines the KE penetrating effect with a fragment or, respectively sub-projectile generation in such an advantageous manner that for an entire series of applications this ammunition concept in itself is sufficient to fulfill the set tasks. The decisive restriction in this functional principal consists of in that, for initiating the lateral effects, it is necessary to provide an interaction with the target, only then will there be built up a suitable internal pressure, through which the end ballistically active projectile casing can be laterally accelerated, or respectively disintegrated.

Through the present invention there is disclosed a way by means of which, with the least possible restrictions in the range of the effectiveness, there can be joined not only the power spectrum of purely inertial projectiles with those of explosive/fragmentation/multipurpose/tandem projectiles, but also the function of heretofore not combinable separate types of ammunition can be integrated therewith. Thereby, it becomes possible to combine the properties of the most different types of ammunition concepts in a single active carrier. This does not only lead to a significant improvement in the heretofore known multipurpose projectiles, but also to an almost unlimited broadening of the conceivable spectrum of utilization against ground, air and sea targets, and in the defense against airborne bodies.

The invention does not intend to utilize pyrotechnic powder or explosive materials alone as casing disintegrating or fragment accelerating elements. Such types of projectiles are known in the most different types of embodiments with and without triggering devices (referring; for example, to German DE 29 19 807 C2). Also German DE 197 00 349 C1 already mentions this capability; for example, in combination with an expansive medium as a individual component.

2. Discussion of the Prior Art

From the disclosure of U.S. Pat. No. 4,625,650 there is known an explosive incendiary projectile which is equipped with a hollow cylindrical as well as aerodynamically configured copper jacket, with a tubular penetrator consisting of heavy metal with an explosive charge. With consideration to the relatively small caliber (12.7 mm) a sufficient penetrating effect with additional lateral effect is alone not achievable due to physical reasons. Its active components in their functioning manner also do not provide the subject matter which is represented within the scope of this invention.

A further projectile is known from U.S. Pat. No. 4,970,960 which essentially encompasses a projectile core, as well as therewith associated and thus connected tip with a formed on mandrel, whereby the inner mandrel is arranged in a bore in the projectile core. It can be constituted of a pyrophoric material; for example, zirconium, titanium or their alloys. Also this projectile is not active; and as well does not contain any expansion medium.

From the disclosure of German Patent No. 32 40 310 there is known an armor rupturing projectile, by means of which there should be attained a conflagration effect in the interior of the target, whereby the projectile encompasses a cylindrical metal member which is extensively shaped as a solid body with a thereto attached tip, as well as an incendiary charge arranged within the hollow space of the metal member which charges; for example, is formed as a solid cylindrical body or as a hollow cylindrical casing. With regard to this projectile, the outer shape remains unchanged during penetration, in the interior there should be produced an adiabatic compression with an explosive-like combustion of the incendiary charge. Also in this instance, there are no active components present, and there are also no means for achieving a dynamic expansion of the metal body acting as a penetrator and its lateral disintegration or fragmentation.

In an extremely broader embodiment of all heretofore known solutions for the generation of lateral effects, there should be mostly provided basically as auxiliary means a sufficient internal pressure generating chemical and/or pyrotechnic aide, and not only minimized, but through its embedding in pressure transmitting media, under the lowest possible pyrotechnic demand or, respectively, volumetric use, there is achieved an optimum disintegration of these surrounding, fragment or sub-projectile producing or emitting casings or segments. Through this separation of the functions of pressure generation or pressure propagation or, respectively, pressure transfer there for the first time opens itself the heretofore in all arrangements known spectrum of application for individual active elements, projectiles or warheads. As examples, there should here serve expelled elements from large calibered ammunition externally or internally of a target, for expel airborne bombs for the attacking of shelters, for warheads up to TBM (tactical ballistic missile) defense, and for utilization in the so-called killer satellites, and finally in the utilization in super cavitating torpedoes (highest speed torpedoes).

From the disclosure of German Patent No. DE 197 00 349 C1 there are disclosed projectiles or warheads which, by means of an internal arrangement for the dynamic formation of expansion zones, produce subprojectiles or fragments with an intense lateral effect. Principally, this hereby relates to the interaction of two materials upon striking against armored targets, or during the penetration into or through homogeneous or structured targets in such a manner whereby the internal dynamically damaged material builds up a pressure field relative to material surrounding it, with a higher speed of an in or through penetrating material, and thereby imparts to the outer material a lateral velocity component. This pressure field is determined through the projectile, as well as through the target parameters: Since such types of penetrators, in their initial form as well as their individual components (fragments, subprojectiles) should possess a greatest possible end ballistic effect, for the casing there affords itself steel or preferably tungsten-heavy metal (WS). From the intended disintegration at specified target parameters there is then obtained a palette of suitable expansion media. In accordance with the selected combination, there are already produced impact speeds at less than 100 m/s expansion pressures which afford a dependable disintegration of the projectile or warhead. Technical or material specific auxiliary means or aids, such as for example, the configuring or, respectively, the partial weakening of the surface, or the selection of brittler materials as the casing material are basically not prerequisites; however, they expand the scope of configurations and the spectrum of use for these so-called PELE penetrators.

SUMMARY OF THE INVENTION

The present invention relates to a further developed active effective body in which a pressure-generating arrangement possesses one or more pressure-generating elements, whereby the mass of the pressure-generating arrangement is low in relationship to the mass of the inert pressure-transmitting medium.

The active effective body pursuant to the present invention possesses an internal inert pressure transfer medium, an active body casing, a pressure-generating arrangement which borders an inert pressure transmitting medium or is introduced into the latter, and an activatable initiating or triggering arrangement. The pressure-generating arrangement hereby possesses one or more pressure generating elements, whereby the mass of the pressure generating arrangement is low in relation to the mass of the inert-pressure-transmitting medium. It has been evidenced that for such kind of assembled active member with a low mass ratio between the pressure-generating arrangement and the pressure transmitting medium, by means of a pressure impulse which is initiated by a triggering signal a detonator can effect a lateral disintegration of such an active body.

The active effective body pursuant to the present invention distinguishes itself from the classically usual explosive material projectiles and the fragment modules which are to be disintegrated by means of an explosive, especially through the basic concept of a penetrator which disintegrates into subpenetrators or which forms subpenetrators, whereby the subpenetrators possess a main velocity component in the direction of flight of the projectile. The pressure-generating arrangement takes up only a small component of the projectile or warhead, so that increased significance is imparted to the pressure-transfer medium. The pyrotechnic energy of the pressure-generating arrangement is transmitted without any measures optimally and without loss to the active body casing. Also, in contrast with the different usual systems, there can be eliminated any damming of the explosion energy of the pressure-generating arrangement, for example, through the introduction of a damming material between the explosive material and the fragment jacket.

The as a low designated ratio of the mass of the pressure generating arrangement relative to the mass of the inert pressure transmitting medium comprises preferably a maximum of 0.6, and especially preferably comprises a maximum of 0.5. There can also be selected still lower ratio values of a maximum of about 0.2 to 0.3.

Furthermore, it is advantageous that the ratio of the massive pressure generating unit relative to the total mass of the pressure-transmitting medium and the active body casing be limited to a maximum of 0.1 or a maximum of 0.05. Especially preferred is the ratio of $\leqq 0.01$, whereby there can also be a selected still lower values.

The pressure-transmitting medium consists preferably entirely or partially of a material which is, selected from the group of lightweight metals or their alloys, plastically deformable metals or their alloys, duraplastic or thermoplastic synthetic materials, organic substances, elastomeric materials, glass-like or pulverous materials, pressed bodies of glass-like or pulverous materials, and mixtures or combinations thereof. Moreover, the pressure-transmitting medium can be constituted of pyrophoric or other energetically positive, meaning for example, combustible or explosive materials. The pressure-transmitting medium can, in addition thereto, also be a pasty, jelly-like or, respectively, gelatinous or liquid, or respectively liquidous.

The present invention relates to an active projectile or an active effective body, whereby the end ballistic penetrating effect is combined with an either programmed and/or through the target which is to be attacked specified subprojectile and/or fragment formation. Thereby, the entire effective spectrum is covered for different targets in a heretofore unknown manner, in that a technically basically universally conceived penetrator, through a changing of individual projectile parameters, reaches the intended effects or target coverings in the best possible mode, in that the concept determined by the invention is extensively independent of the type of the projectile or airborne body or, respectively, their stabilization (for instance, spin or aerodynamically stabilized guidance mechanism, form stabilization or otherwise deployed into the target) and, respectively the caliber (full caliber, subcaliber) and, respectively, with regard to the deployment or acceleration type (for instance, cannon accelerated, rocket accelerated), designed as a projectile/warhead or integrated therein. The inventive arrangement (projectile or airborne body) basically also does not require any inherent or own speed for triggering its function. However, its inherent speed determines the end ballistic speed in the direction of flight. Thus it is to be particularly effectively combinable in combination with the active component and the point-in-time of triggering.

The universal possibilities of the inventive arrangement thereby comes into expression in that, on the one hand without any change in the basic principle, it can pertain to an arrow or slender projectile with the highest penetrating power, with additional arrangements which over the entire length or in partial regions, can relate to arrangements forming fragments or subprojectiles, and, on the other hand, preferably pertains to a projectile container which is filled with a (for example pyrotechnic) active element, which again can limit subprojectiles or fragments along the entire length or only partial regions. This is basically achieved along the trajectory, upon approach to a target, upon impact, at the beginning of the penetration, during passage through the target, or first only after an effected penetration.

The inventive penetrator (projectile or airborne body) besides its active properties possesses a constructively adjustable relationship between penetrating power and lateral effect. The basically inert active mode is thereby initiated by means of a position-determined or independently of the position of the active body initiatable arrangement or installation for the triggering or supporting of the lateral effectiveness (for example, the lateral active effects). This is achieved by means of a suitable inert transfer medium; for example, such as a liquid, a pasty medium, a plastic material, a polymer material or a plastically deformable metal a quasi hydrostatic or, respectively, a hydrodynamic pressure field producing pyrotechnic/detonative arrangement, (also without any primary explosive) with a built in or function-specified triggering initiation with integrated triggering safety.

FIGS. 1A and 1B illustrate such types of active laterally effective penetrators ALP (active laterally effective penetrator), FIG. 1A in a shorter (for example, spin stabilized) and FIG. 1B in a lengthier (for example aerodynamically stabilized) constructional manner with an outer ballistic hood or tip 10. The encompassing casing body 2A, 2B, which due to its material properties mass and velocity is end ballistically effective forms the central KE components. This either entirely or partially closed body 2A, 2B encompasses an internal portion 3A, 3B which, in the region of a desired active lateral effect, is filled with a suitable transmitting medium 4, which then by means of a controllable pyrotechnic arrangement 5 transmits the generated pressure to the encompassing body 2A, 2B, and thereby causes a disintegration into fragments of subprojectiles with a lateral motion component.

At the build up of the pressure field in the inert medium 4 and upon its effect on the surroundings, the mutually acoustic resistance of the adjoining media (density p×longitudinal speed of sound c) is of significance. This is because it determines the degree of the reflection and thereby also the energy which can be imparted by the inert medium 4 to the encompassing casing 2A, 2B. This interrelationship is explained, for example, in the ISL-report ST 16/68 by G. Weihrauch and H. Müller "Investigations with new armor materials".

Upon an imbalance of the acoustic resistances, the quotient $(P_1 \times c_1)/(P_2 \times c_2)$ can be designated as m (with m>1), and one then defines as a reflective coefficient a the expression $\alpha=(m-1)/(m+1)$. This consideration is not only of interest for the pressure-transmitting medium, but then can also be utilized when for example, two casings or media should come in combination into use (refer to FIGS. 13, 15 16A, 16B, 23 and 24).

From the above definition there is obtained that for liquids (c≈1500 m/s) or similar materials, as a rule over 95% of the incident shock energy is reflected at the boundary surface between pressure-transmitting medium/casing (steel or WS). However, also for a lightweight metal, such as aluminum, with a WS casing there still reflected over 70%, for a light weight metal compared to a steel casing, approximately 50%. A particularly broader operative play region is obtained with the utilization of plastic materials and polymers. There the sound propagating speeds fluctuate between 50 m/s and 2000 m/s, the densities between about 1 and 2.5 g/cm$^3$. Obtained thereby in the combination with duraluminum as the casing and plastic/polymer as the pressure transmitting medium, for example, for an arrangement with double-jacket or a practice projectile, is a reflective degree of 60% or higher. This determines decisively the efficiency of the pressure-transmitting medium with respect to speed (time), the pressure-transmitting and thereby the sensitivity (spontaneity) of the lateral expansion or also relative to the axial pressure build up as a function of location and time.

Concerning the inert medium 4, this relates as a rule to a material which is in a position, without any greater damping losses, to dynamically transmit pressure forces. However, in instances it is also contemplatable that there are desired damping properties, such as for specified disintegration tasks or for achieving particularly slow disintegration speeds. The inner medium can furthermore be configured variably throughout its length or, respectively in its material properties (for example, different speeds of sound) and thereby produce different lateral effects. However, it is also thinkable that through different damping properties of the pressure transmitting medium 4 there can be effect axially different disintegrations of the casings 2A, 2B. Furthermore, this medium 4 can also possess other properties, for example, effectiveness-enhancing or effectiveness-supporting properties. The elements which are introduced or molded into the inert medium 4, or into the inner space 3A, 3B bounding inner casings or assemblies (for example, inserted subprojectiles) prevent neither the PELE nor its ALP properties inherent to the system.

The active pyrotechnic unit 5 can be constituted of a single, in relation to the size of the active body, small electrically ignitable detonator 6, which is connected with a simple contact reporter, with a timing element, a programmable module, a receiver component and a safety component as an activatable triggering device 7. This activatable triggering device 7 can be arranged in the region of the tip region and/or tail end region of the penetrator and can be connected by means of a conductor 8.

The tip 10 can be constructed hollow or solidly. Thus, for example, it can be serve as a housing for auxiliary arrangements such as, for example, sensors or triggering and respectively, safety elements for the active pyrotechnic unit 5. It is also possible that the tip has integrated therein power supporting elements (for example, as in FIGS. 43A through 43D).

In the aerodynamically stabilized version 1B there is indicated a rigid guidance mechanism 12. Also this can contain in a central region auxiliary installations as indicated hereinabove. It is also basically comtemplatable that the active body contains an electronic component in the sense of a data processing unit (so called "on board-systems").

In the present invention it does not relate to an explosive projectile or an explosive body or an explosive/fragment projectile of the usual constructional type, and also does not relate to a projectile with a fuse or detonator of the usual constructional type with the necessary and extremely complex (primary-secondary explosive material separating) safety devices. It also does not relate to a projectile which basically possesses a PELE construction pursuant to DE 197 00 349 C1. However, it can be extremely advantageous, and in most cases application it can also be combined with ALP tasks when, for example, in an active combination or for the assurance of a lateral effect also in an inert instance in intended and particularly advantageous applications, there can be integrated the properties of a passive lateral penetrator of the known PELE constructional type.

BRIEF DESCRIPTION OF THE ACCOMPANYING DRAWINGS

Further features, details and advantages can be ascertained from the following description of preferred embodiments of the invention, having reference to the accompanying drawings; in which:

FIG. 6A illustrates different examples of geometries for pressure generating elements;

FIG. 6B illustrates further examples of geometries for pressure generating elements;

FIG. 6C illustrates still further examples of geometries for pressure-generating elements;

FIG. 6D illustrates further examples of geometries for pressure generating elements with conical tips and roundings;

FIG. 6E illustrates an example for a combination of two pressure generating elements of different geometries with a transition region;

FIG. 7 illustrates different examples of hollow pressure generating elements;

FIG. 40A illustrates a representation of an exemplary embodiment of a three-part ALP projectile which illustrates the base construction, whereby the active part is provided in the region of the tip;

FIG. 40B illustrates a representation of a three-part ALP projectile similar to FIG. 40A, whereby the active part is provided in the center region;

FIG. 40C illustrates a representation of a three-part ALP projectile similar to FIG. 40A, whereby the active part is provided in the tail end region;

FIG. 40D illustrates a further exemplary embodiment of a three-part ALP projectile with an active tandem arrangement;

FIG. 41 illustrates an exemplary representation of an explanation for an ALP projectile;

DETAILD DESCRIPTION OF PREFERRED EMBODIMENTS OF THE INVENTION

Figure 1A:
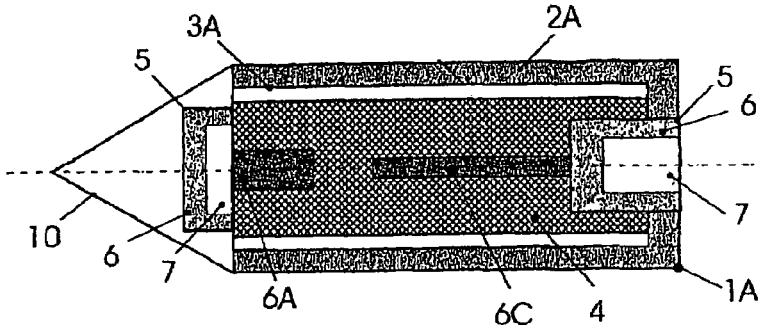
FIG. 1A illustrates a spin stabilized version of an ALP.

In the disclosure of German DE 197 00 349 C1 there are set forth possibilities for the configuration of the space within the casing which is to be disintegrated also in combination with different materials. All of these configuration features can be integrated basically in an active part in accordance with the present invention. In an explanation thereof, hereby should also be mentioned the conical configuration of the pressure generating internal space, referring to FIGS. 12, 34 and 42B, and the division of the cross-sectional surface into segments with, for example, different pressure-transmitting materials, as in FIG. 33. Moreover, inasmuch as the pressure build-up is separately undertaken, the palette of the materials which are to be employed is practically unlimited. This is comparably valid also for the dimensions (thicknesses) of the various components which are employed herein.

In the disclosure of DE 197 00 349 C1 there are furthermore mentioned a few examples of the configuration of the fragments or, respectively, the subprojectile producing or emitting casing in combination with a dispersing medium, also in combination with a central penetrator. This technologically widely employable and extremely variant range of laterally active projectiles or warheads can be expanded up to the most extreme situations or applications through the utilization of pressure-generating pyrotechnic arrangements. This is particularly applicable to large calibered ammunition and to warheads.

As already mentioned, the range of utilization for active laterally effective penetrators is practically unlimited. Thereby, the pressure generating components and the eventually therewith associated auxiliary installations are of particular significance. It is also a special advantage of the present invention that the effectiveness of an ALP (active laterally effective penetrator) can be advantageously utilized even with technically relatively simple arrangements.

With regard to the technical construction for the initiation of the pressure generating elements, there must be distinguished between a simple contact ignition, which are already employed for projectiles of different types of configurations and therefore stand available, a delayed ignition (also known), a proximity ignition (for example, through radar or infrared technology) and a remote-controlled ignition along the trajectory, for example, through a timer element.

It is a further advantage of the present invention that the latter is not bound to specified systems, or to their states of development. In contrast, through its universal applicability and through the technological configuration capabilities, it compensates for the properties of specified system extensively in accordance with their states of development. Furthermore, it is additionally advantageous to regard to the present invention that with to significant advances which were accomplished within the last few years concurring the miniaturization of triggering devices in connection with electronic improvements and new developments. Thus, for example, systems such as electric foil initiation (EFI) and an ISL technology are known, which fulfill such functions with extremely small dimension (a few millimeters in diameter up to 1 to 2 centimeters in length) and small masses at a low energy requirement. The lowest energy demand are necessitated above all by the simplest ignition systems. Thus it must be provided a balance between necessary safety and demand.

Basically, the tip sets forth an essential parameter which is necessary for the power capability of a projectile. In German DE 197 00 349 C1 this point of view is extensively treated. However, it is also applicable for the scenario in the utilization of the extensively discussed and included as the possible area for utility of the present invention. In this connection, imparted to the projectile tip besides the reduction of the external ballistic rather are previously positive (supportive) functions then those which are negative; for example, the penetration or the initiation of a function hindering properties. As positive examples there can be mentioned, among others: The tip as constructional space, ejectable tip, a tip as a pre-positioned penetrator.

Figures 9A, 9B, 9C, 9D:
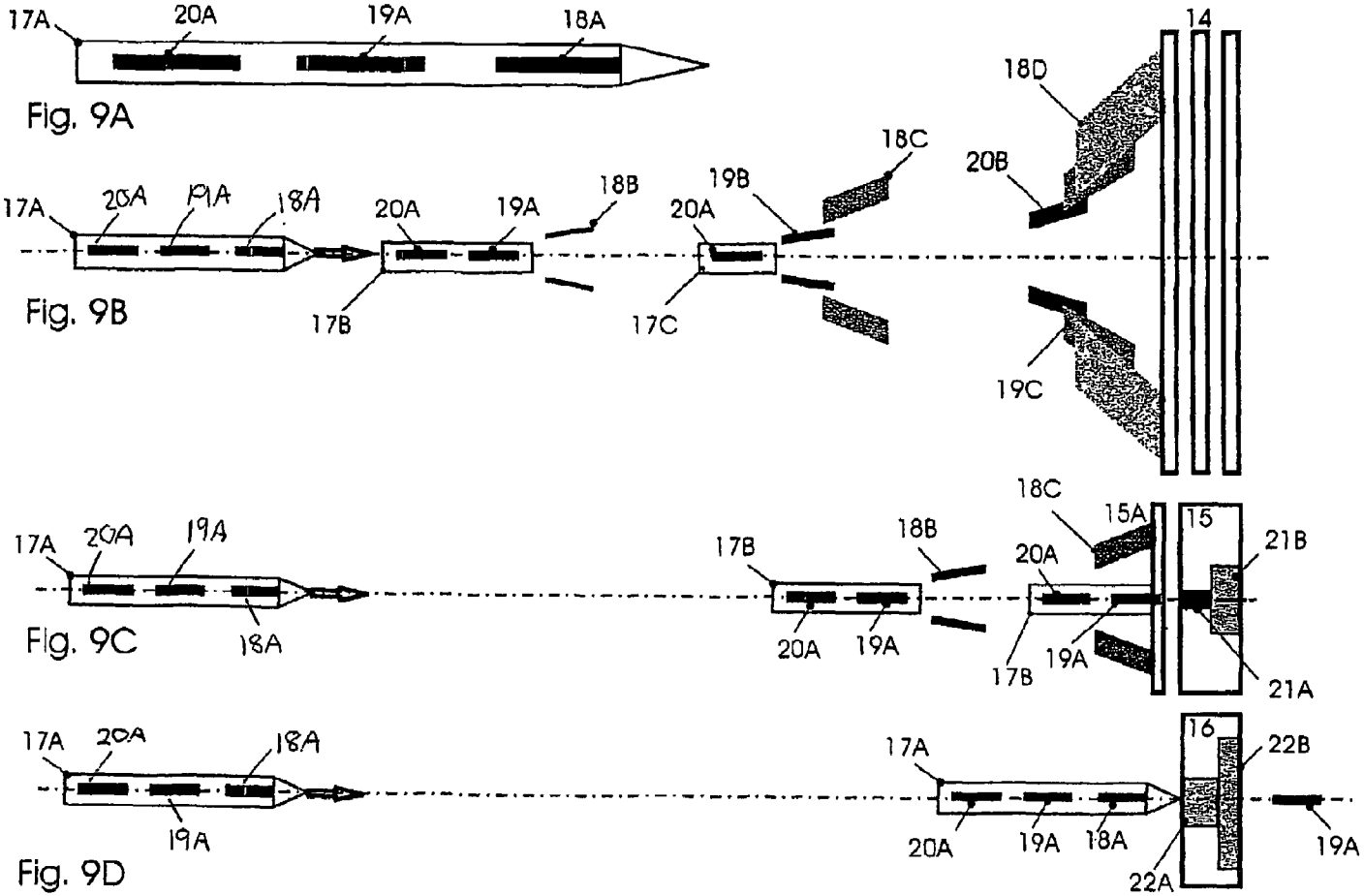
FIG. 9A illustrates the principal construction of an ALP projectile with three active zones positioned behind each other.
FIG. 9B illustrates a schematic representation of an explanation of the mode of functioning of the ALP projectile of FIG. 9A, in which all three active zones are activated prior to reaching the target.
FIG. 9C illustrates a schematic representation of an explanation of the mode of functioning of the ALP projectile of FIG. 9A in which only the forward active zone (for example, occasionally also the rearward active zone) is activated prior to reaching of the target.
FIG. 9D illustrates a schematic representation of an explanation of the mode of functioning of the ALP projectile of FIG. 9A in which all three active zones are only activated upon reaching the target.

The active principle in accordance with the present invention is also adapted for the controlled projectile disintegration and spatial limitation of the effective distance; to the for example, upon missing a target or during the design of practice projectiles. Hereby it can be advantageously employed, compressed or densified materials compressed powder, plastic materials or fiber materials) as the casing material, which are subjected either a fine distribution upon being subjected to pressure, or can be end ballistically divided into practically ineffective particles. There can also be disintegrated or laterally accelerated only a portion of the projectile/penetrator, such that the remainder of the projectile/penetrator basically remains still capable of functioning. Thus, for example, during flight there can be emitted a plurality of fragment planes, as illustrated in FIG. 9B, or there can be sprung away a certain number, thereof immediately directly prior to impact, for example, as illustrated in FIG. 9C.

The ALP principle is consequently particularly adapted for projectile/warheads with self-destruct installations. Thus, with a relatively low requirement or, respectively extremely small demand on additive volume or, respectively, loss of volume, there can be achieved an assured self-destruction. Thereby, it is even basically possible that even for slender KE projectiles there can be provided a system for limiting the penetrating depth.

Projectiles of this type also suited in a special manner for the attacking of oncoming threats, for example, such as warheads or TBMs (tactical ballistic missiles) or also battle or surveillance drones. The last mentioned is imparted an increased significance in the filled of combat. They are only difficult to combat with direct hits. Also, usual fragmentation projectiles are practically low efficient on the basis of opposing situations with drones and fragment distribution. The effective manner of the present invention in combination with a corresponding triggering unit here, however, promises an extremely effective possibility of utilization.

A projectile conception in accordance with the proposed invention is also adapted in a specific measure for use by means of rocket (booster) accelerated penetrators or as the active components of rocket like airborne bodies. These, for example, besides the classical range of application can be employed with large caliber barreled weapons which are employed in the attacking of sea targets and as on board rockets for combat aircraft.

Figure 2A:
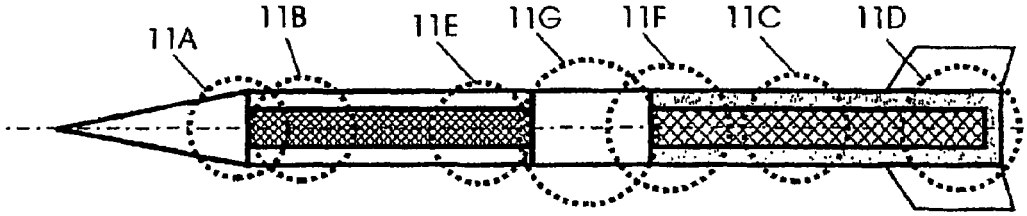
FIG. 2A illustrates examples for the positions of auxiliary arrangements for the control, or respectively triggering and safety of the pressure-generating arrangements for arrow projectiles.
Figure 2B:
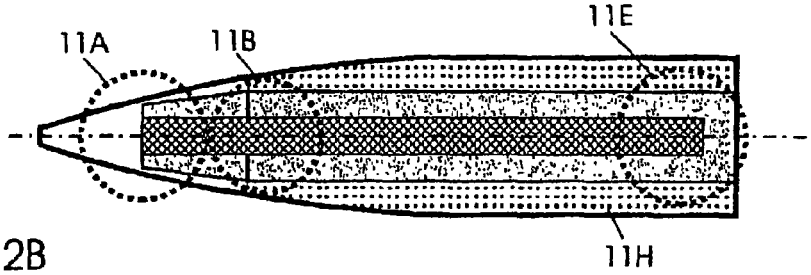
FIG. 2B illustrates examples for positions of the auxiliary arrangements for the control or, respectively triggering and safety of the pressure generating components for spin stabilized projectiles.
Figure 48A:
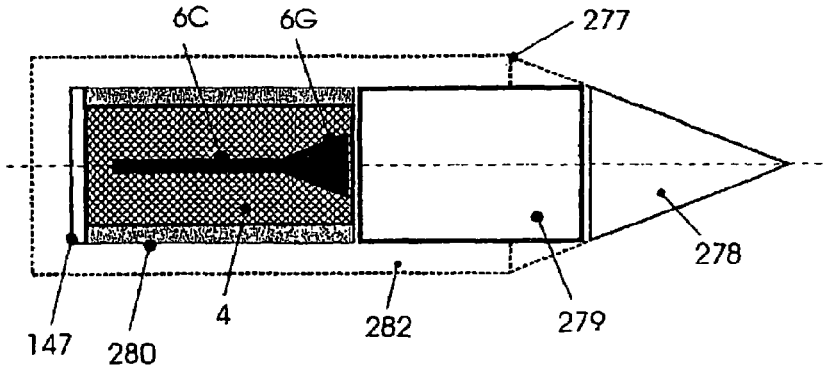
FIG. 48A illustrates an exemplary embodiment of a three-part, modular spin-stabilized projectile (or airborne body)
Figure 48B:
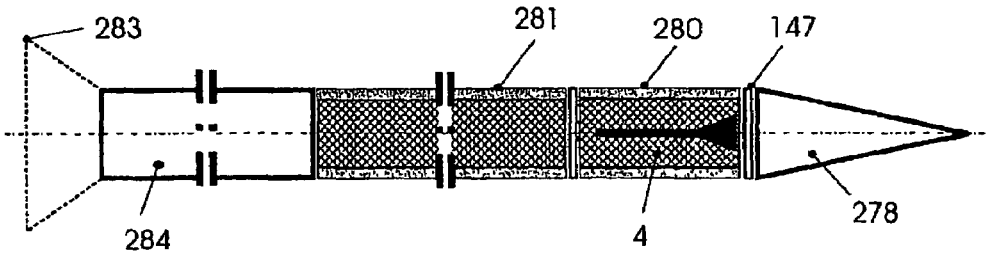
FIG. 48B illustrates an exemplary embodiment of a four-part modular aerodynamically-stabilized projectile (or airborne body)

In FIGS. 2–9 and 12–41 there is illustrated a multiplicity of exemplary embodiments. These have the task of not only to explain the capabilities of the effective principle in accordance with the present invention, but also to impart to one skilled in the art a multiplicity of technological solution possibilities in the conception of active laterally-effective penetrators. In FIGS. 2A and 2B there are shown examples for the positions of auxiliary installations of the active component. The aerodynamically stabilized version is illustrated in FIG. 2A and is divided into two separate modules so as to explain that especially for lengthier penetrators or comparable active carriers, such as for example, rocket-accelerated penetrators, it is also possible to provide a subdivision of the active components or a mixture with other active carriers, as also indicated in FIGS. 48A and 48B. Preferred positions are here in the tip region 11A, the forward region of the first active laterally effective projectile module 11B, the rear region of the active laterally projectile module 11, the forward 11F, central 11C, and the rearward region 11D of the second active laterally active projectile module or, respectively, the projectile tail-end or the center region between the modules 11G.

In the fin stabilized version illustrated in FIG. 2B, the positions of the auxiliary arrangements are located preferably in the tip region 11A, in the forward projectile region 11B, or in the tail end region 11E. Furthermore, there can also be arranged a receiver unit (auxiliary installation) in the space 11H between the ALP and the outer casing.

In the two projectile versions, the remaining part of the tip can be either hollow or filled (such as with an active material). For a sub caliber design of the active part, the intermediate space up to the outer skin can also be employed for additional active a carriers or as a constructional space for auxiliary arrangements.

Figure 3A:
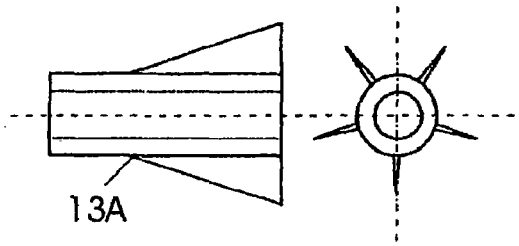
FIG. 3A illustrates a first example for a tail/guidance mechanism shape (for example, for receiving the auxiliary installations) in the form of a rigid wing guidance mechanism.
Figure 3B:
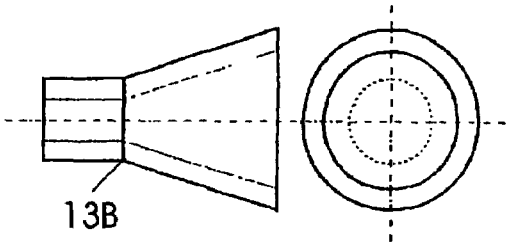
FIG. 3B illustrates a second example of a tail/guidance mechanism shape (for example, for receiving of the auxiliary arrangements) in the form of a conical guide mechanism.
Figure 3C:
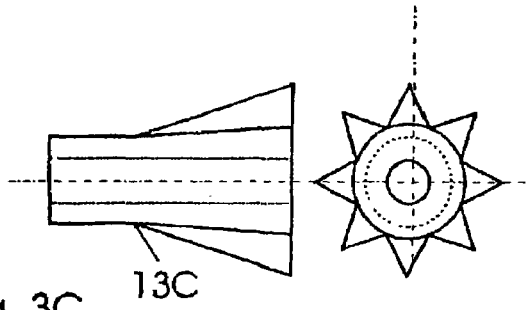
FIG. 3C illustrates a third example for a tail/guidance mechanism shape (for example, for receiving of the auxiliary arrangements) in the form of a star guidance mechanism.
Figure 3D:
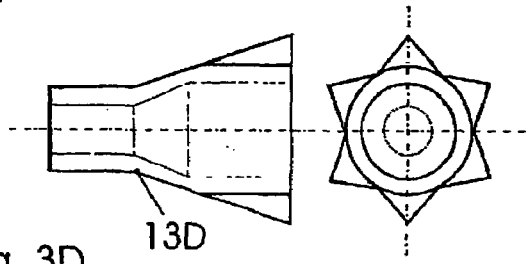
FIG. 3D illustrates a fourth example for a tail/guidance mechanism shape (for example, for receiving of the auxiliary arrangements) in the form of a guidance mechanism with a mixed construction.

Through the utilization of specialized guidance geometries there can be created greater volumes for the integration of the auxiliary installations. In FIGS. 3A–3D there are set up a number of examples. Thus, FIG. 3A illustrates, especially for comparative purposes, the installed wing guidance mechanism 13A. FIG. 3B illustrates a conical guidance mechanism 13B, FIG. 3C a star guidance mechanism 13D, and FIG. 3D a mixture consisting of wing and conical guidance mechanism 13D. It is also possible to contemplate an apertured conical guidance mechanism, as well as guidance mechanisms constituted as ring surfaces or other types of stabilizing arrangements.

Figure 4A:
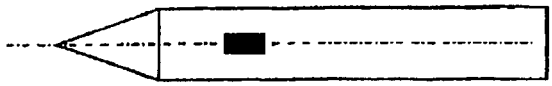
FIG. 4A illustrates a first example of the embodiment of an arrangement of pressure generating elements in the form of a compact pressure generating unit in the forward center portion.
Figure 4B:
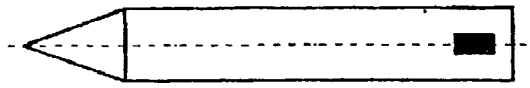
FIG. 4B illustrates a second example of the embodiment of an arrangement of pressure generating elements in the form of a compact unit in a tail end region.
Figure 4C:
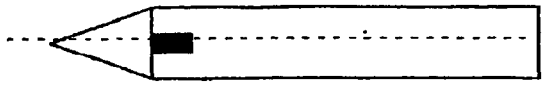
FIG. 4C illustrates a third example of the embodiment of an arrangement of pressure generating elements in the form of a compact unit in the region proximate the tip.
Figure 4D:
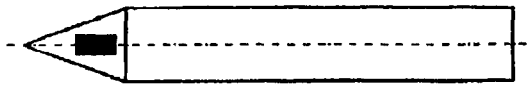
FIG. 4D illustrates a fourth example of the embodiment of an arrangement of pressure generating elements in the form of a compact unit located in the tip.
Figure 4E:
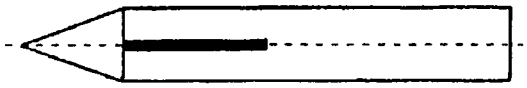
FIG. 4E illustrates a fifth example of the embodiment of an arrangement of pressure generating elements in the form of an expanded slender unit in the forward region of the penetrator.

In FIGS. 4A–4K there are illustrated basic positions and structures of the pressure-generating element or, respectively, pressure generating elements of active laterally-effective penetrators. Thus, FIGS. 4A and 4B illustrate those types of pyrotechnic arrangements in a compact construction (for example, exemplary embodiments in FIGS. 6A, 6B, 6C and 6D) in the forward central region or respectively in the rearward projectile region or, respectively, in the tail end region, and in FIGS. 4C and 4D proximate the tip or, respectively, in the tip region. In FIG. 4E there extends a slender pressure-generating element somewhat through the forward half of the penetrator, in FIG. 4F over the entire penetrator length. The arrangement of FIG. 4C corresponds to the simulation example in FIGS. 43A/B, the arrangement of FIG. 4E to the simulation example in FIGS. 44A/B.

Figure 4F:
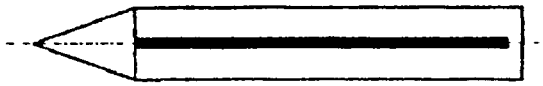
FIG. 4F illustrates a sixth example of the embodiment of an arrangement of pressure generating elements in the form of a through extending slender unit.
Figure 4G:
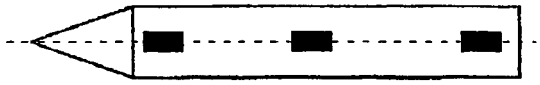
FIG. 4G illustrates a seventh example of an embodiment of an arrangement of pressure generating elements in the form of three uniformly distributed compact units.

FIG. 4G represents the case in which a plurality of pressure generating elements are located in a penetrator/projectile/warhead, as is also the case in the illustrations of FIG. 9.

Figure 4H:
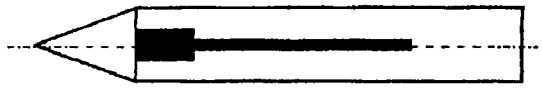
FIG. 4H illustrates a eighth example of an embodiment of an arrangement of pressure generating elements in the form of a combination of a compact unit in the region proximately the tip with a slender unit.
Figure 4I:
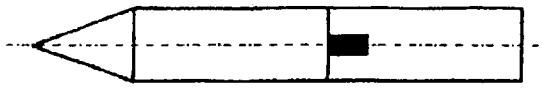
FIG. 4I illustrates a ninth example of an embodiment of an arrangement of pressure generating elements in the form of a two-part projectile with a compact unit in the rearward portion.
Figure 4J:
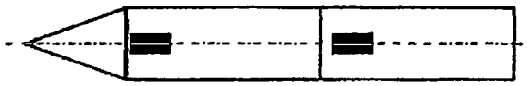
FIG. 4J illustrates a tenth example of a embodiment of an arrangement of pressure generating elements in the form of a two part projectile with compact elements in both parts.
Figure 4K:
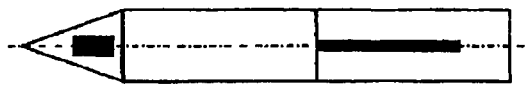
FIG. 4K illustrates an eleventh example of an embodiment of an arrangement of pressure-generating elements in the form of a two part projectile with a compact unit in the projectile tip and with a slender unit in the rearward projectile part.

In FIG. 4H there are located in the single part ALP, two different pressure generating elements (numerical simulations in FIGS. 46A–46D). FIGS. 4I–4K represent a two-part ALP projectile. Thus, FIG. 41 represents, as an example, a two-part ALP with an active part in the rearward element/module, whereas in FIG. 4J there are located compact pressure generating elements in both projectile parts. These can be activated either separately or also individually. FIG. 4K illustrates mixed pressure generating elements (a compact pressure generating unit in a tip and a slender unit in a rearward part) so as to achieve specified disintegrations, which as a rule is determined by the type of the target which is to be attacked and the intended effect.

Naturally, the number of the active modules which are to be connected behind each other is basically not limited and is only specified through constructive conditions, for example, such as constructional length which stands available, the scenario of utilization as well as preferably fragment or subprojectile emitting and the type of projectile or warhead.

Due to reasons of a simple manufacturer as well as handling, and especially due to the practical suitable possibilities of configuration, there are employed primarily explosive material modules as pressure generating elements. However, it is also possible to contemplate basically other types of pressure generating installations. For example, there must be mentioned herein a method of chemical pressure-generation through an air bag gas generator. Also it is possible to contemplate the combination of a pyrotechnic module with a pressure or, respectively, volumetric generating element.

Figure 5A:
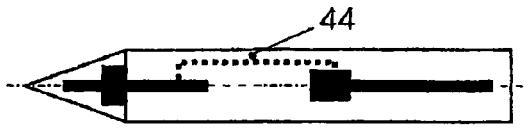
FIG. 5A illustrates an example of an ALP projectile with a control/safety/triggering unit in the tip region with a control and signal line leading to the second unit.
Figure 5B:
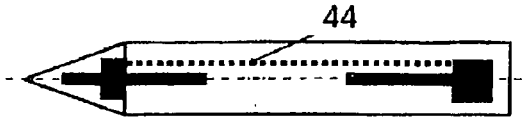
FIG. 5B illustrates a further example of an ALP projectile with a control/safety/triggering unit in the tail region with a control and signal line leading to a second unit.

Illustrated in FIGS. 5A and 5B are examples for the interjoining/connection of diverse pressure-generating elements in a single projectile. This connection 44 can be effected, for example, by means of a signal line (transmission charge/initiation line/fuse cord or wireless with or without a time delay. Understandably, illustrated herein are only a few representative possibilities, the various combination capabilities are practically unlimited.

Thus, in FIGS. 4A–4K there are illustrated examples for the arrangement of pressure generating elements for active laterally effective penetrators, consequently, the combination capabilities of the examples which are represented in FIGS. 6A–6E for pressure generating elements are still correspondently broadened. Due to reasons of clarity, the pressure generating elements are illustrated, in comparison with their constructions, in an enlarged scale.

Thus, FIG. 6A illustrates four examples for compact, locally concentrated elements (also detonators), for example, a spherically-shaped part 6K, a short cylindrical part 6A in the magnitude of length L to diameter D of L/D of approximately 1; part 6G illustrates as a further example a short truncated conical member, and part 6M a tipped slender cone. FIG. 6B illustrates as examples a pressure-generating element 6B with L/G of between 2 and 3, and a slender pressure-generating element 6C. This can relate, for example, to an explosive cord or a fuse cord similar detonator (L/D>about 5).

As a further example, in FIG. 6C there is illustrated a disk-shaped element 6F. Naturally, there are also contemplatable combinations with the illustrated or with further elements, as shown by example 6P.

In FIG. 6D there are illustrated exemplary embodiments for the case in that, by means of a suitable configuration, the pyrotechnic elements especially in the forward part of a penetrator or in the tip region of the encompassing parts can be imparted a preferably radial velocity component. This is preferably implemented by means of a conical configuration of the tip of the pressure generating element 6H, 6O, 6N, or through a rounded portion 6Q.

It can also be of particular advantage that in accordance with the desired effectiveness or disintegration of a projectile, a plurality of pressure generating elements are permitted to act together. Thus. FIG. 6E illustrates the combination of a short intensely laterally acting cylinder 6A with a slender, lengthy element 6C through a transition part 6I. By means of such arrangements there can be produced, in accordance with selected pressure transition media, different lateral velocities also in a cylindrical projectile part.

FIG. 7 illustrates examples of hollow pressure generating/pyrotechnic components. Hereby this can relate to a ring shaped element 6D or a hollow cylinder. These can be open (6E) or partially closed (6L).

Basically, it is also possible to proceed from the standpoint that for the full unfolding of the effect/disintegration, only a solid small part of a mass of a pressure-generating medium is required. Thus numerical simulation as well as the implemented experiments have proven that, for example, for large caliber projectiles (penetrator diameter >20 mm) only a few millimeter thick explosive cylinders in combination with a liquid or with a PE are sufficient for an extremely efficient disintegration.

Figure 8A:
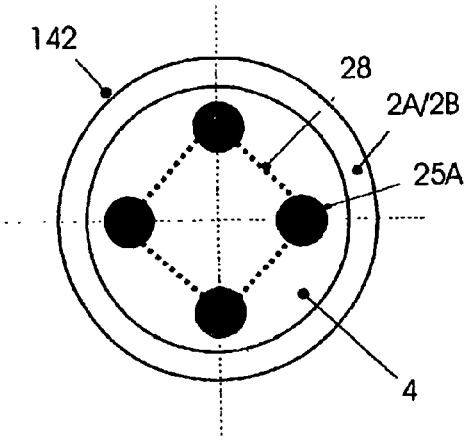
FIG. 8A illustrates an example of an arrangement for interconnected pressure generating elements.
Figure 8B:
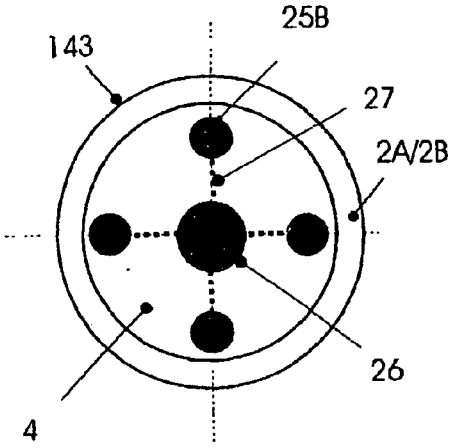
FIG. 8B illustrates an example of the arrangement of a central penetrator connected with external pressure generating elements.

A further possibility of configuration of active laterally effective projectiles or warheads through the accelerating components is represented by FIGS. 8A and 8B.

Thus, in FIG. 8A there is illustrated a cross section 142 as an example for four pressure generating elements 25A (for example, in an embodiment in accordance with 6C) which are located externally of the center of a pressure-transmitting medium 4, and which are connected through a conduit 28. That type of capability is viewed in combination with FIGS. 15, 16B, 18, 19, 29, 30–30D and also 31, and respectively, 33.

In FIG. 8B, as a cross sectional view 143 there is represented an example for a central pressure-generating module 26, which by means of the lines 27 is connected through the cross sectional positioned pressure-medium transmitting medium further pressure generating elements 25B.

Clarified through the examples shown in FIGS. 2–7 and explained in connection therewith for the axial projectile construction and the variation capabilities for the pressure generating elements, there can also be clarified at this point, meaning without any special consideration further parameters such as for example, diverse pressure-transmitting media, such as, media, especially radial structures or constructively specified details of the significant advantage of active laterally effective penetrators, as shown for example in FIGS. 9A–9D.

In the considerations in conjunction with active laterally-effective penetrators it is expedient that suitable distance ranges be defined relative to the target, inasmuch as from the literature there cannot be ascertained any generally determined values. It can be distinguished between the immediate proximate region (distance to the target of less than 1 meter), the region close to the target (1 to 3 meters), the region approaching the target (3 to 10 meters), the intermediate range of distance (10 to 30 meters), greater distances to the target (30 to 100 meters), remoter distance to the target (100 to 200 meters), and even greater distances to the target (greater than 200 meters).

FIG. 9A illustrates the reference projectile 17A, which is illustrated in enlarged and not to scale. It should be assembled in a cylindrical part of three in close approximation equally designed active modules 20A, 19A, and 18A (referred to FIG. 4G) which are initiated in different positions relative to the three selected target examples 14, 15 and 16.

In FIG. 9B there is illustrated the case in which the projectile 17A is activated in a closer region ahead of the target (here approximately five projectile lengths) in such a manner that the three stages 18A, 19A and 20A disintegrate in a tight sequence subsequent to each other. The remaining penetrator 17B subsequent to the disintegration of the module 18A still constitutes the two active modules 20A and 19A, whereas the forward module 18A has been disintegrated into a fragment ring 18B. After a further approach into a target 14, which here for example consists of three individual plates, in the remaining projectile 17C the fragmentation range 18B has expanded to the ring 18C and the module 19A has already formed the fragment or subprojectile ring 19B. The right-side partial image represents the point-in-time in which there has been formed the ring 18D from the fragment ring 18C through a further lateral expansion, and from the fragment ring 19B of the second stage 19A the fragment ring 19C, and from the stage 20A of the remaining projectile 17A there has been formed the fragment or subprojectile ring 20B. Eventually, the fragment densities are hereby reduced in accordance with a geometric ratios.

Thereby, this example illustrates the large lateral power capacity of those types of active laterally effective penetrator in accordance with the present invention. From the heretofore represented technical details there can be easily derived that, for example, through the triggering distance or through a suitable configuration of the accelerating elements, that there can be covered a much larger surface. Moreover, for example, the disintegration can be installed in such a manner that a desired remaining penetrating power by at least the central fragments is still assured. Such constructed penetrators are in particular adapted for relatively light target structures, for example, against aircraft, unarmored or armored helicopters, unarmored or armored naval vessels and lighter target/vehicles in general, especially also expanded ground targets.

FIG. 9C illustrates a second representative example for a controlled projectile disintegration. Hereby, the projectile 17A is first activated at a close rage to the target, which here consists of a thin pre-armoring 15A and a thicker main armoring 15. The forward active part 18A of the projectile 17A has already formed a fragment or subprojectile ring 18B; which during a further course windows towards the ring 18C, which fully impacts the surface of the forward plate 15A. The remaining penetrator 17B strikes against the pre-armoring 15A. It can act, for example, as an inert PELE-module and then forms a crater 21A in the main armoring 15 which uses up the second part 19A. The remaining projectile module 20A can now penetrate through the hole 21A formed by the penetrator part 19A, and either inertly or actively, penetrates to the interior side of the target through the crater 21B. Hereby, there are also formed larger crater fragments and accelerated into the interior of the target.

In FIG. 9D, the projectile 17A strikes directly against the target 16 which in this example is assumed as being solid.

Hereby, the module 18A should be designed so as to be active for the immediate proximate region (triggering through contact by the tip) so as to form a crater 22A which is comparably larger with regard to that shown by example in FIG. 9C. Through this, for example, the following module 19A can travel through into the interior of the target. In the indicated crater picture there is assumed that also the third module 20A upon striking or being activated through a delay element and thusly forms as an extremely large crater diameter 22B, and produces corresponding residual effects (effects subsequent to the penetration).

It has been experimentally proven, for example, that for inert PELE-penetrators, in contrast with slender homogeneous arrow projectiles, at a penetrating power of the inventive ALP corresponding plate thickness, there can be displaced a greater crater volume by a factor of approximately 7 to 8 times. This recognition was explicitly disclosed for example in the ISL report S-RT 906/2000 (ISL: German-French Research Institute St. Louis).

At an active module, this value can become significantly greater. Hereby there must above all be considered that in accordance with the Cranz's Model Law, the displaced crater volume for each energy unit is constant in a first approximation. This signifies that a high lateral effect is, as a rule, connected with a loss of penetrating depth. Overall, however, in the majority of the encountered instances, there is already obtained a generally positive balance, alone in that the large surfaced target stressing in proximity to the impact hole (due to an unstressing emanating from the rear side), in contrast with the displacement in the interior target, has energetically a much more advantageous stamping as a result. Especially with thinner multiple plate target there can be achieved hereby a total penetrating power (through-penetrating total target plate thickness), which throughout is comparable with the penetrating power of more compact or even more massive penetrators in homogeneous or quasi-homogeneous targets. However also for homogeneous target plates, there can be calculated for laterally effective penetrators with a comparably high penetrating power, since the punching out or stamping out in the region of the crater is expedited or initiated earlier.

Also here it is again apparent that with projectile constructions in accordance with the invention there is a practically suitable palette available in order to achieve the desired effects in accordance with the present or the expected target scenarios in an heretofore unknown range spectrum.

As already mentioned, the selection of pressure transmitting media opens a further parameter filed with respect to an optimum design not only for a specified target spectrum, but also with respect to a projectile concept with basically the greatest possible width of range in application. Thereby in the herein listed examples and corresponding explanations there is proceeded from inert pressure-transmitting media, however, understandably, in certain instances reaction capable materials or the lateral effect supporting active media can assume such types of functions.

Besides the already mentioned inert pressure-transmitting media, coming into consideration are also materials with special behaviors under pressure loads such as for example, glass-like or polymer materials.

In this connection, it is also possible to point out the comments in German DE1970 00 349C1. These, in the present instance, are not only to be accepted in their full context but also with respect to the particularities of the present invention, there comes into question a still greater palette of work materials such as, for example, ductile metals of higher density up to heavy metals, organic substances, for example cellulose, oils, fats, or biologically decomposable products) or to a certain extent, compressible materials of different strengths and densities. Some materials can also provide additional effects, for example such as an increase in volume due to unstressing in the case of glass. Understandably it is also possible to contemplate mixtures and compounds, as well as compressed powder or materials with pyrotechnic properties and the introduction of embedding of further materials or bodies into the region of transmitting medium or, respectively the pressure-transmitting media, to the extent that thereby the functional dependence is not impermissible restricted. Through the type, mass and configuring of the pressure generating media, the room for changing configuration is thereby practically unlimited.

Figure 1B:
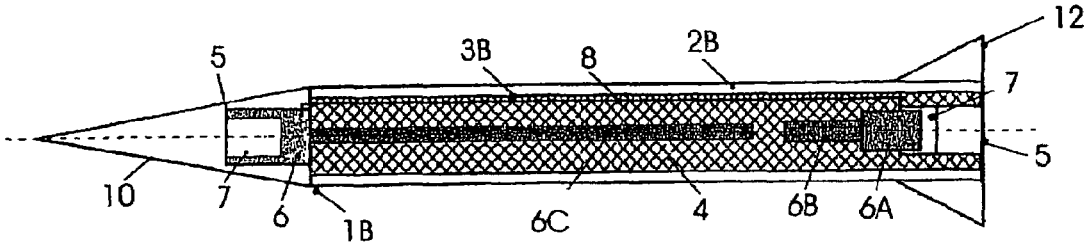
FIG. 1B illustrates an aerodynamically stabilized version of an ALP.
Figure 10:
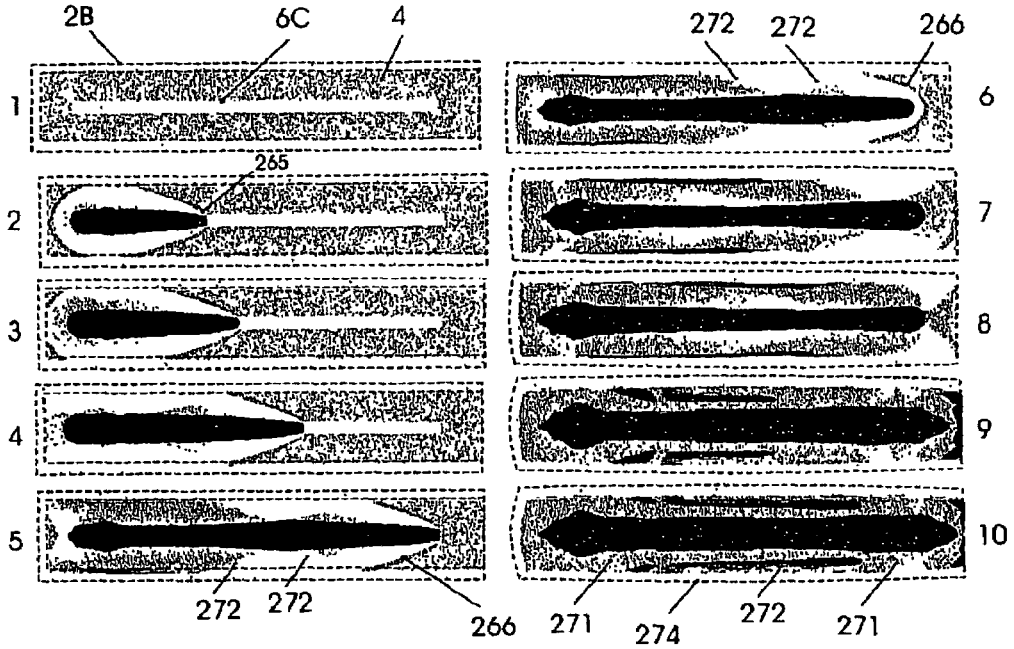
FIG. 10 illustrates a representation of a numerical 2D simulation of the pressure generation by means of a slender fuse cord-similar detonator pursuant to FIG. 4F.
Figure 44A:
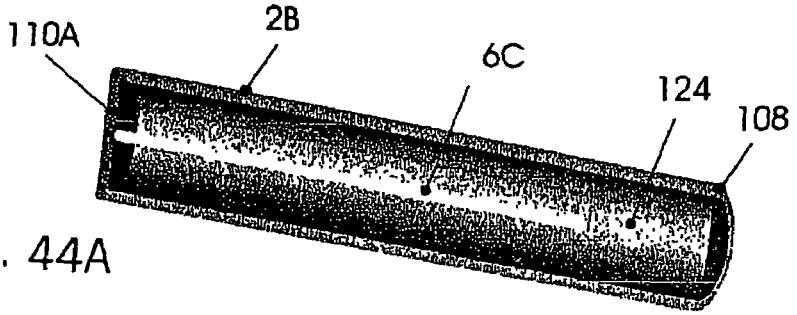
FIG. 44A illustrates a representation of a 3D simulation of an ALP projectile with a slender pressure generating unit, a WS jacket and a liquid as a pressure-transmitting medium, corresponding to FIG. 4E.

FIG. 10 illustrates ten partial images of a numerical 2D simulation of the pressure propagation for a slender pressure generating element (explosive cylinder) 6C in a penetrator assembly according to FIG. 1B (partial image 1), compared with FIGS. 4F and 44A/B. The detonation front 265 runs through the explosive material cylinder (detonation cord) 6C and expands in the liquid 4 as a pressure build up wave (pressure propagation front) 266 of (partial images 2–5). The angle of the pressure propagation front 266 is determined by the speed of sound in the pressure-transmitting medium 4.

After the cylinder has been detonated therethrough the wave 266 expands further a the speed of sound of the medium 4, (here significantly slower refer to partial images 6 and 7). From partial FIG. 5 there can be recognized the waves 272 which are reflected from the inner wall of the casing 2B. Due to the waves 272 which are reflected from the casing 2B, this leads to a rapid pressure balance (partial images 8–9), a forward extended pressure compensation 271 is recognizable from partial image 10. As the reaction begins, the casing wall expands elastically, at a sufficient wave energy, in effect, a corresponding pressure build up, it expand plastically 274. The dynamic material properties hereby decide themselves through the type and manner of the casing deformation such as, for example, the formation of different fragment sizes and subprojectile shapes.

The illustrated simulation example with a relatively thin explosive material cylinder demonstrates clearly the dynamic build-up of a pressure field in the pressure-transmitting medium for casing disintegration in accordance with the present invention. With the geometric configuration, the selection of the pressure generating element and the employed materials, there is available a multiplicity of parameters for achieving optimum effects.

Figure 11:
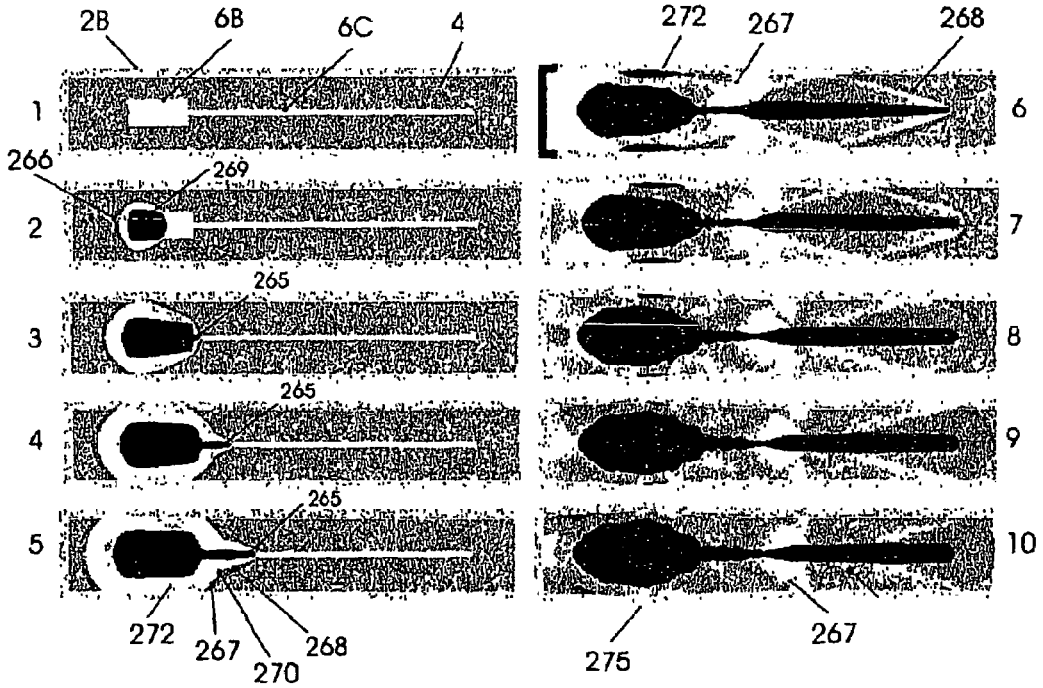
FIG. 11 illustrates a representation of a numerical 2D-simulation of the pressure generation by means of two different pressure-generating units pursuant to FIG. 4H.

FIG. 11 illustrates ten partial images of a numerical 2D simulation of the pressure propagation for an assembly of the pressure-generating element pursuant to FIG. 4H (partial image 1), compared with FIGS. 6B, 6E and 45A–45D. Through this example there should be illustrated the influence of different explosives geometries and their interplay.

Partial image 2 illustrates the detonation front 269 of the explosive material cylinder 6B and the pressure wave 266 which is propagates in the medium 4. In partial image 3, the detonation from 265 runs within the here extremely slender explosive material cylinder 6C. Recognizable from part images 4 and 5 is the transition 270 of the pressure waves of the short cylinder 267 and the pressure wave of the explosive cord 268. Just as well, the wave 272 which already ran back from the casing inner wall. In the partial images 6–10 there is effected the reaction on the side of the explosives cord, as is described in FIG. 10. Due to the smaller diameter of the explosives material cylinder or, respectively, the explosives cord, the wave image is more defined, and the pressure balance is effected in a manner extending in time. The partial images similarly illustrate that the pressure field which is formed by the shorter, thicker explosive material cylinder 6B remains limited localized over the entire represented time interval, and that merely a pressure front 267 runs towards the right through the inner space. This can be employed, at a suitable design, understandably also alone for certain disintegration effects in the right part of the casing. Correspondingly, located on the outside of the casing 2B is a clearly defined bulging 275 which can be already clearly recognized at this point in time. As to whether the stressing for a tearing open of the casing is adequate, can be tested, for example, by means of a 3D-simulation (refer to FIGS. 45A–45D).

Through a pasty, at least during the introduction of a quasi-fluidly or, for instance, a polymeric or otherwise at least transitionally plastic or flowably rendered pressure-transmitting medium, in a technically especially simple manner there can be implemented practically any suitable internal form and/or structure. Also connected therewith are considerable constructive or manufacturing technological advantages such, as for example, the embedding, molding or casting in of fuses, detonators or active components in a manner which in a mechanical art was frequently not at all be possible ("rough" inner cylinder, deformation on the inside, and the like). For the formation of the inner surfaces, for example, on the basis of manufacturing view points, the FIGS. 18–21 with the related parts of the specification or description text in Patent DE 1970349C1 can be employed herein.

Embodiments within the context of the present invention are possible in a lateral as well as in an axial direction. Hereinbelow, in the following description there are set forth examples for both cases, whereby it is also possible to contemplate advantageous combinations.

Figure 12:
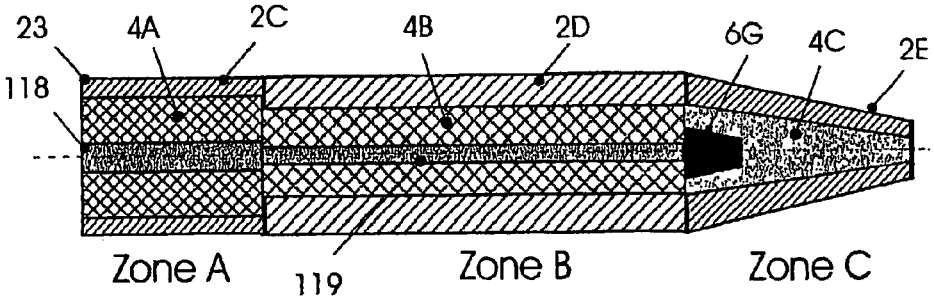
FIG. 12 illustrates a further exemplary embodiment of an ALP projectile pursuant to the invention with two axial zones A and B of different geometrical configurations.

FIG. 12 illustrates, as an example, an active laterally effective projectile 23 with two axial zones A and B connected behind each other, with respectively each having a pyrotechnic element 118, 119, a (for example, different) pressure-transmitting medium 4A, 4B and the (also each his own) fragment/subprojectile producing casings 2C, 2D in a different configuration, as well as a third zone C. The zone C represents, for example, a reducing casing 2E with a correspondingly configured pyrotechnic elements 6G in the rearward region which, for instance, can be encompassed by the pressure-transmitting medium 4C, or also a reduction in the transitional region towards the tip of a projectile.

The exemplary embodiments illustrated in FIG. 12, are thereby technologically of interest, inasmuch as they illustrate a capability that the tail end which usually counts as a dead weight or the tip can be configured as a fragmentation module. In consideration of the fact that for usual projectile geometries the tip length as well as the conical tail end region can consist of throughout two penetrator diameters flight diameters, through a suitable design there can be imparted an efficient power conversion to a significant portion of the projectile.

Figure 13:
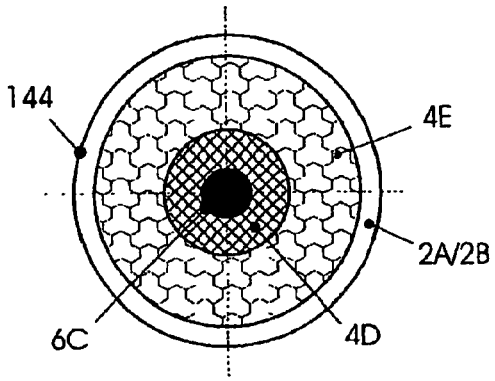
FIG. 13 illustrates an exemplary embodiment of an active effective body pursuant to the invention with symmetrical construction, a central pressure generating element as well as an internal and external pressure-transmitting medium, shown in cross-section.

FIG. 13 represents for an exemplary embodiment 144 with a cross section and symmetrically assembly, a central explosive material cylinder 6C, as well as an inner 4D and an outer pressure-transmitting medium 4E, and a fragment/subprojectile-producing or emitting casing 2A/2B. Hereby it is also thinkable throughout that especially through a variation of the internal components 4D there can be achieved special effects. Thus, for instance, the medium 4D can act in a delayed manner on the pressure-transmitting, or also acceleratingly or respectively in accordance with the selected materials, support the pressure effect. Furthermore, through the distribution of the surface between 4D and 4E, the average density of these two components can be varied, which can be of significance in the design of projectiles.

Not least due to manufacturing technological viewpoints, there is set the question concerning necessary tolerances or other cost intensive (for example, due to technically difficult or complex) details. It is furthermore an important advantage of the present invention that with regard to the herein utilized materials, as well as with regard to manufacturing tolerances, insofar as it relates at least to the effectiveness, that only set minor requirements must be set. A further particular great advantage in this connection can be ascertained in that, for a series of pressure-transmitting media, the position of the pressure generating module (at least for a sufficient thickness of the surrounding pressure transmitting medium) can be selected in an almost any suitable manner.

Figure 14:
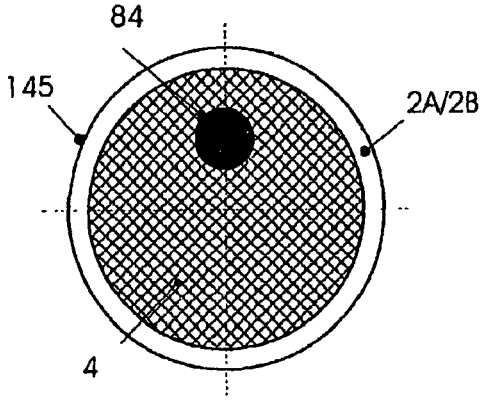
FIG. 14 illustrates an exemplary embodiment of an active effective body pursuant to the invention with an eccentrically positioned pressure generating element, shown in cross-section.
Figure 46A:
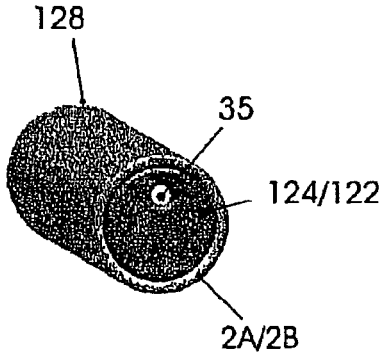
FIG. 46A illustrates a representation of a 3D simulation of an ALP assembly with an eccentrically positioned pressure-generating element (cylinder)
Figure 46B:
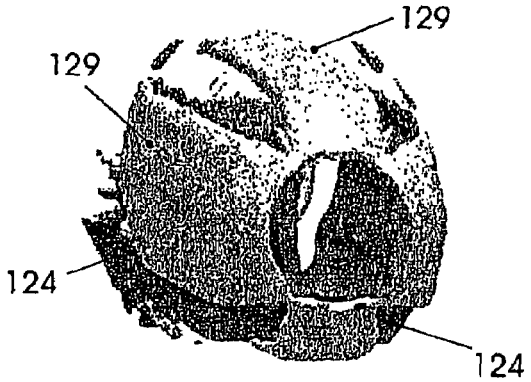
FIG. 46B illustrates a representation of a 3D simulation for a dynamic disintegration of an arrangement pursuant to FIG. 46A, 150 μ seconds subsequent to triggering, whereby a liquid is utilized as a pressure-transmitting medium.
Figure 46C:
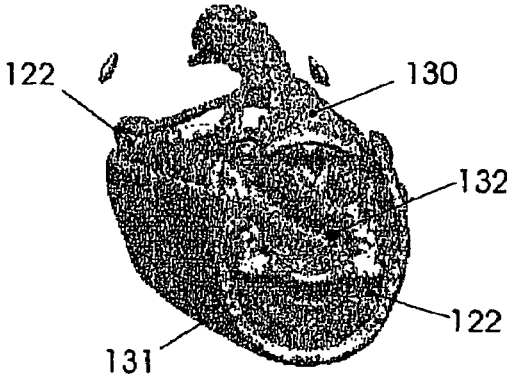
FIG. 46C illustrates a representation if a 3D simulation for a dynamic disintegration of an arrangement pursuant to FIG. 46A, 150 μ seconds subsequent to triggering, whereby aluminum is utilized as a pressure-transmitting medium.

Thus, FIG. 14 illustrates an example 145 for an eccentrically positioned pressure generating pyrotechnic element 84 (referring to numerical 3D simulations in FIGS. 46A through 46C).

15A illustrates, by way of example, an ALP-cross section 30 and analog to FIG. 13, however, with an eccentrically positioned pressure-generating element 32 (for example, the explosive material closest cylinder 6C) as well as an inner (4F) and an outer pressure-transmitting medium and a fragment/subprojectile producing or emitting casing 2A/2B. The inner component 4F should be preferably constituted of a good pressure-distributing medium, for example, a liquid or PE (see explanations with regard to FIG. 31). Otherwise, concerning the two components there are applicable the conditions which have been already explained with regard to FIG. 13. At a suitable design of the medium 4G it can, however, also be of interest to achieve controlled asymmetrical effects. This can be achieved, for instance, in that the heavier mass side of the inner pressure-transmitting medium 4 acts as a damming for the pressure generating element 32, and thereby achieved is a directional orientation (refer also to the comments concerning FIGS. 30B and FIG. 33).

It is now apparent that by means of this known advantage there can be followed two concepts, for instance, an extensive pressure balance or a locally desired pressure distribution. Especially for a plurality of pyrotechnic elements at the perimeter there are obtained hereby technologically-effective interesting possibilities.

Figure 15A:
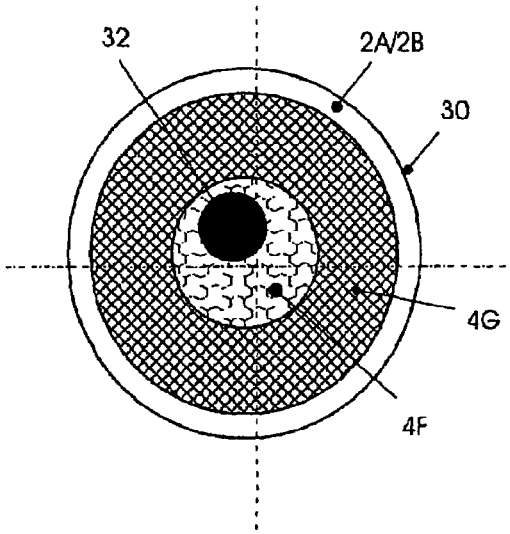
FIG. 15A illustrates an exemplary embodiment of an active effective body pursuant to the invention with an eccentrically positioned pressure generating unit as well as an internal efficient pressure distributing medium and an external pressure-transmitting medium, shown in a cross-sectional view in accordance with FIG. 13.
Figure 15B:
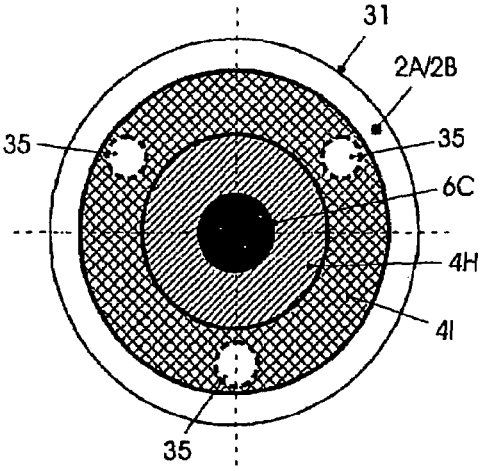
FIG. 15B illustrates, in cross-section, a similar exemplary embodiment of the active body pursuant to the invention as in FIG. 13, however, with a pressure-generating element in the outer pressure-transmitting medium and with an internal medium forming a reflector.

FIG. 15B accordingly illustrates a construction 31 similar to FIG. 13, however, with a pressure generating unit (for example, corresponding to 6C) in the inner pressure-transmitting medium 4H and pressure generating elements 35 (for example, here three in number) in the outer pressure-transmitting medium 4I, which for example, can be separately activated Understandably, it is also possible to contemplate constructions without the central components.

It is of particular advantage that for projectile or penetrators in accordance with the present invention, large lateral effects can be combined with relatively high penetrating powers. This can be basically achieved through an overall high specific cross-sectional loading (limiting instance is the homogeneous cylinder corresponding density and length) or over the surface the partially effected high cross-sectional loads. Examples for this are massive/thick walled casings or inserted, preferably centrally positioned penetrators with high degree of slenderness (for increasing the penetrating power most possible of materials of high hardness, density/or strength, such as for example, hardened steel, hard and heavy metal). It is also contemplatably that the central penetrator be constructed as a (sufficiently pressure resistant) container with which special parts, materials or fluids can be brought into the interior of the target. In special instances, the central penetrator can also be replaced by a centrally positioned module to which there can be imparted particular effects acting in the interior of the target.

In the following exemplary embodiments there are implemented a series of formulaic solutions for the introduction of such types of end ballistic power carriers with respect to their penetrating capabilities (refer, for example, to FIGS. 16A, 16B, 18, 19, 30C and 31).

Figure 16A:
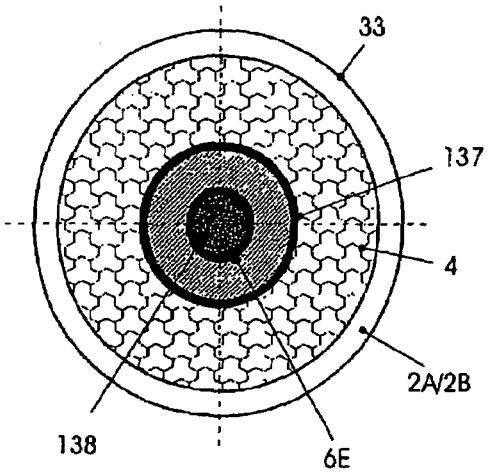
FIG. 16A illustrates a cross-sectional view of an exemplary embodiment of an active effective member according to the invention with a central penetrator having pressure-generating elements in the penetrator and in the outer pressure transmitting medium which, for example, can be separately actuatable.
Figure 16B:
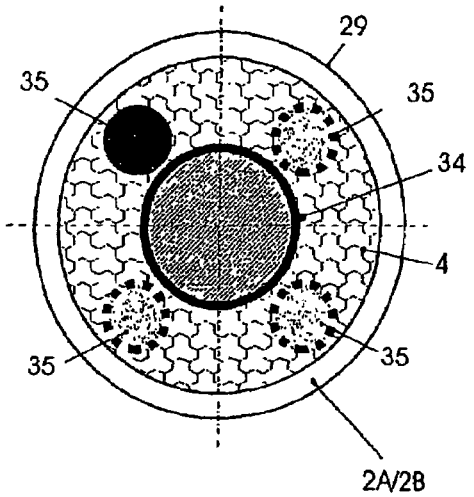
FIG. 16B illustrates an exemplary embodiment of an active effective member pursuant to the invention with a central penetrator with pressure generating elements in the outer pressure-transmitting medium, shown in cross-section.

FIG. 16A illustrates a construction 33 with a central hollow penetrator 137. Located in the hollow space 138 of the penetrator 137 can be effect-supporting materials such as including masses, respectively pyrotechnic technical materials or combustible fluids. Between the casing 2A/2B and the central hollow penetrator 137 there is arranged the pressure-transmitting medium 4. The pressure build up can be carried out, example, through a ring shaped pressure generating element 6E.

As a further example for an inserted central penetrator, illustrated in 16B is a cross-section 29 with four symmetrically positioned pressure-generating elements 35 in a pressure-transmitting medium 4 which encompasses a central massive or solid penetrator 34. This penetrator 34 not only achieves high end ballistic penetrating powers, but it is also adapted to serve as a reflector for the explosive material cylinder 35 which is located on its surface (or in proximity to the surface). Further examples bring this effect particularly clearly into validity (for examples, the FIGS. 18, 19, 30A and 30B).

Figure 17:
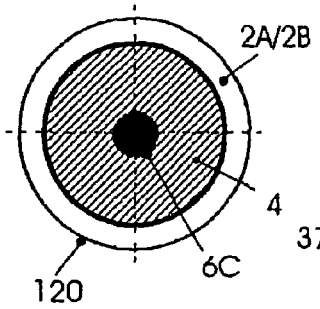
FIG. 17 illustrates a standard assembly of an ALP projectile, shown in cross-section, which is also a reference standard for further exemplary embodiments.

For the following figures, FIG. 17 should serve as a standard embodiment of an ALP cross section 120 in the simplest inventive configuration.

Figure 18:
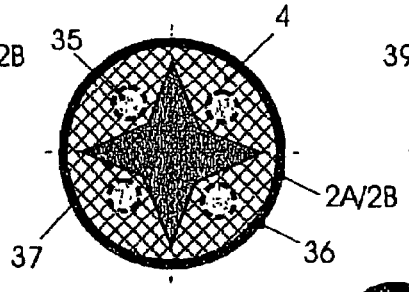
FIG. 18 illustrates an exemplary embodiment of an ALP assembly pursuant to the invention with a central penetrator with a star-shaped cross-sections and a plurality of pressure-generating elements, shown in cross-section.

FIG. 18 illustrates an ALP construction 36 with a central penetrator 37 of star shaped cross section and four symmetrically arranged pressure generating elements 35. This star shaped cross section, for example, as well as also the quadratic or rectangular cross section in FIG. 19 and the triangular cross section in FIG. 38, serves for suitable cross sectional shapes.

Figure 19:
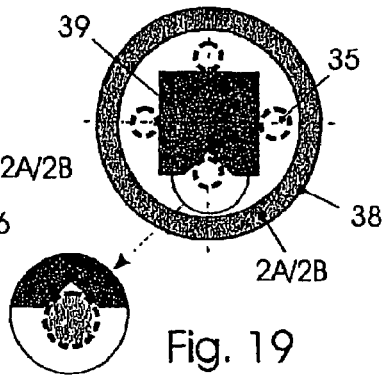
FIG. 19 illustrates a cross-sectional view of an exemplary embodiment of an ALP assembly pursuant to the invention with a central penetrator with rectangular or quadratic cross-section and a plurality of pressure-generating elements.

FIG. 19 illustrates an ALP construction 38 with a central penetrator 39 with a rectangular or quadratic cross section and four symmetrically distributed pressure generating elements 35. These elements (for example, explosive material cylinder) for achieving a directed effect can be introduced, for instance, either completely or partially into the central penetrator, (see the partial view).

Figure 20:
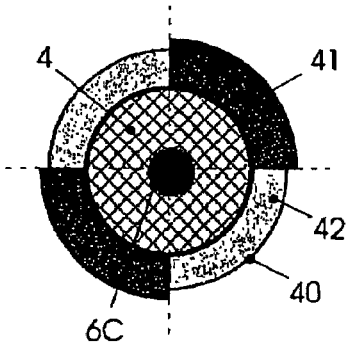
FIG. 20 illustrates a cross-section of an exemplary embodiment of an ALP assembly pursuant to the invention, in accordance with FIG. 9A with four casing segments.

FIG. 20 illustrates an ALP construction 40 in accordance with FIG. 17 with two respectively oppositely arranged casing segments 41 and 42 as an example for possible different material coverings over the circumference or also for a different geometric configuration of the casing segments over the circumference. Due to external ballistic reasons, the different segments can also, however, be axially symmetrically arranged.

Figure 21:
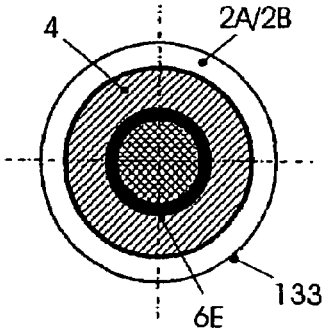
FIG. 21 illustrates an exemplary embodiment of an ALP assembly pursuant to the invention with two laterally arranged pressure transmitting media, shown in cross-section.

FIG. 21 illustrates an ALP construction 133 with a pressure generating element 6E corresponding to FIG. 7. The pyrotechnic part 6E can hereby encompass a central penetrator or also every other medium, for example, though a reaction capable component or a combustible fluid (refer also to the remarks with regard to FIG. 16A).

Figure 22:
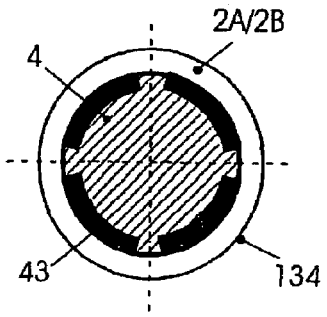
FIG. 22 illustrates an exemplary embodiment of an ALP assembly pursuant to the invention with a segmented pressure-generating element, shown in cross-section.
Figure 30C:
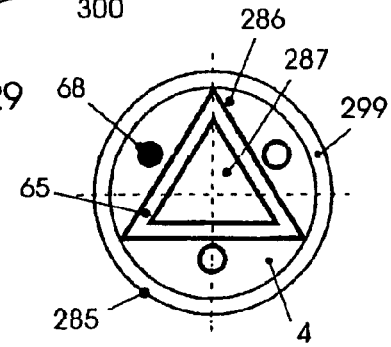
FIG. 30C illustrates an exemplary embodiment of an ALP assembly in cross-section similar to that of FIG. 30B, however, with a triangular hollow shaped body.
Figure 30A:
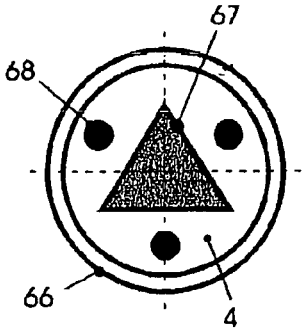
FIG. 30A illustrates an exemplary embodiment of an ALP construction with a solid central penetrator of suitable cross-section, and three pressure generating units which are arranged in an inert transmitting medium.

FIG. 22 illustrates an ALP assembly 134 with segmental pressure generators 43 (explosive material segments; refer to FIG. 30A).

Figure 23:
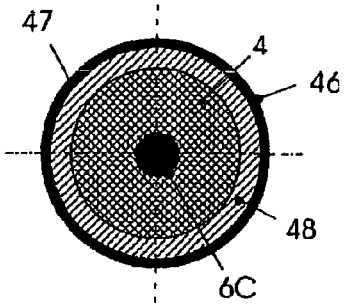
FIG. 23 illustrates an exemplary embodiment of an ALP assembly pursuant to the invention with two different laterally arranged casing shells, shown in cross-section.

FIG. 23 illustrates an ALP assembly 46 with two concentrically superimposed casing shells 47 and 48. Hereby, this can relate, for instance, to a combination of a ductile and brittle material or materials as well with different properties. That type of configuration also represents as an example for casing-supported penetrators ("jacketed penetrators"). Such types of casings can then be required for a few constructions when, for example, they should be ensured a specified dynamic strength, such as upon firing, or when axially arranged modules should be bound together by means of such a guidance or support casing at least during firing, and along the trajectory to the extent that such functions are not assumed by correspondingly to designed propulsion mechanism.

Figure 24:
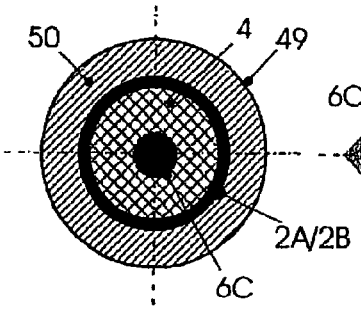
FIG. 24 illustrates, in cross-section, an exemplary embodiment of an ALP assembly pursuant to the invention in accordance with FIG. 17 with an additional external jacket.

FIG. 24 illustrates an ALP assembly 49 with a central explosive material cylinder 6C in the pressure-transmitting medium 4 and an internal jacket 2A/2B in connection with a relatively thick outer jacket 50. Alternatively, it is also possible to employ as a central pressure-generating unit, a hollow cylindrical explosive material in accordance with 6E from FIG. 21. Then there is also obtained the combination possibility pursuant to FIG. 21. The internal jacket 2A/2B can be constituted in this instance of heavy-metals such as WS, a tempered metal, a pressed powder or also of steel; the outer jacket 50 similarly of heavy-metal, steel or cast steel, light metal such as magnesium duraluminum, titanium or also from a ceramic or non metallic material. Lighter materials which increase the bending resistance (for example, for avoidance of projectile fluctuations in the barrel or during flight), due to their utilization in the outer casing are technologically of special interest. They can form an optimum transition to propulsion mechanisms, and for a limited projectile total masses increase the design ranges (surface weight balance). In that also pre-manufactured further active components can also be introduced, can be ascertained from the explanations in connection with the present invention.

Figure 25:
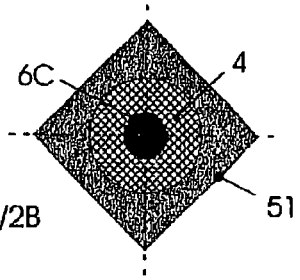
FIG. 25 illustrates, in cross-section, an exemplary embodiment of an ALP assembly pursuant to the invention with a non-circular cross-section.

FIG. 25 illustrates a cross-section 51 through the example of an ALP assembly with a external contour which is not circular during the flight. It is understandable that this manner of functioning which is based on the invention is not bound to specific cross sectional shapes. Special configuration can frequently assist in that the range of configurations is still further broadened. Thus, it is contemplatable that, for example, the cross-section illustrated in FIG. 25 can preferably be used to produce four large subprojectiles. This is then of particular advantage when, subsequent to the disintegration of the penetrator, there should still be achieved a high penetrating power by the individual penetrators.

Figure 26:
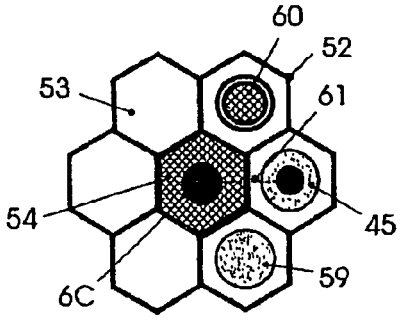
FIG. 26 illustrates an exemplary embodiment of an ALP assembly pursuant to the invention with a six-sided central part according to FIG. 17, and a split ring of preformed subprojectiles or fragments with noncircular cross-section (for example, also with PELE assembly)

FIG. 26 illustrates an ALP assembly 52 with a hexagonally-shaped central part with a pressure generating element 60, a pressure-transmitting medium 54, a fragment ring of preformed subprojectiles (or fragments) with non-circularly shaped cross-section 53, in which, for example, there can again be arranged massive or solid penetrators 59 or PELE penetrators 60, or satellite-ALPs 45. However, it is also contemplatable to provide connections lines explosive cords 61 between the central pressure generating element 60 and the peripheral satellite ALPs 45.

Figure 27:
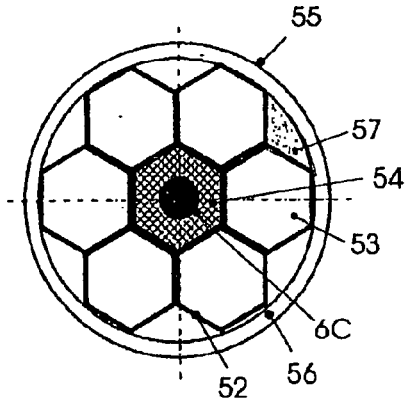
FIG. 27 illustrates an exemplary embodiment of an ALP assembly pursuant to the invention, similar to FIG. 26; however, with a further casing.

FIG. 27 illustrates an ALP assembly 55 in accordance with FIG. 26 with additional jacket or casing 56. For this element 56, there are also applicable the embodiments as described with regard to FIGS. 23 and 24. The partial segments between the hexagonally-shape subprojectile 53 and the jacket 56 can contain, for instance, a filler mass 57 in order to achieve diverse side effects.

Figure 28:
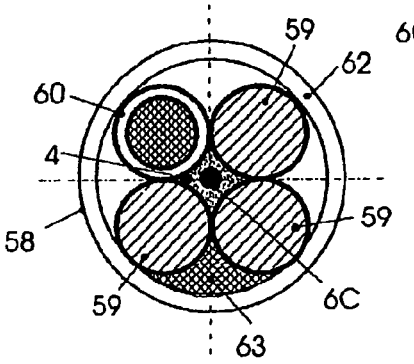
FIG. 28 illustrates an exemplary embodiment of an ALP projectile with four penetrators (for example in PELE constructional mode) and a central pressure generating unit.

FIG. 28 illustrates the example of an ALP projectile 58 with four (here, for example, circularly-shape) penetrators (for example, in a massive or solid 59 or PELE constructional mode 60) and a central accelerating unit 6C in combination with a pressure-transmitting medium 4. Between the inner components 59 or 60 and the outer casing 62 there can be arranged a filler medium 63 which again, in turn, can be designed as an active medium or which can also contain such parts or elements.

Figure 29:
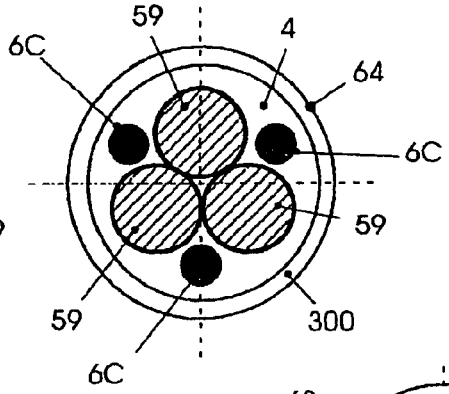
FIG. 29 illustrates an exemplary embodiment of an ALP projectile with three penetrators (for example in a PELE constructional mode) and three pressure-generating units which are arranged in an inert transmitting medium.

FIG. 29 represents a variant/combination of the previously already represented exemplary embodiments (refer, for example, to FIGS. 16B, 18, 19 and 28. The cross-section of the penetrator 64, in this instance, consists of three massive or solid homogeneous subprojectiles 59, three pressure-generating arrangements, for example, corresponding to element 6C, a pressure-transmitting medium 4 and the fragment/subprojectile generating or emitting casing 300. Basically this example stands for multipart central penetrators.

In FIG. 30A there is also represented for demonstration of the almost any suitable configuration range in conjunction with the present invention, a penetrator variant 66 with a central penetrator 67 having a triangular cross-section. The pressure generating installations here consist expediently of three explosive material cylinders 68. These can be initiated either commonly or separately.

Figure 30B:
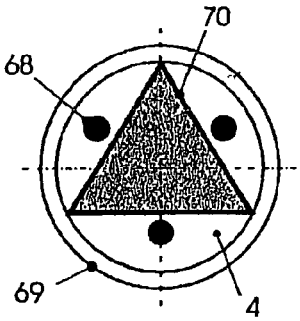
FIG. 30B illustrates an exemplary embodiment of an ALP construction similar to that of FIG. 30A, however, with a solid segment forming penetrator having a triangular cross-section.

In the cross-section 69 illustrated in FIG. 30B, the triangular central penetrator 70 which fills out the entire inner cylinder, divides the interior surface into three regions, which are each equipped with a pressure generating element 68 and a pressure transmitting medium 4. As in the example of FIG. 30A, they can also be commonly or separately activated or initiated. It is also contemplatable, that by means of a separate triggering of the element 68 there can be achieved a controlled lateral effect.

In the cross-section 285 illustrated in FIG. 30C there is arranged in the cylindrical inner space or respectively, in the pressure-transmitting medium 4, a triangular hollow element 286, whose internal space 287 can be additionally filled with a pressure-transmitting medium or other materials enhancing the effectiveness, such as for example, reaction capable components or combustible fluids. For the triangular casing 65 of the element 286, there are the applicable the already above-described conditions. As in FIG. 30B, there are provided three pressure-generating elements 68. Upon the ignition of only one element 68, there is produced a clearly asymmetrical pressure distribution and a corresponding asymmetrical subprojetile or respectively, fragment covering of the encompassing space. (the attached surface).

Figure 30D:
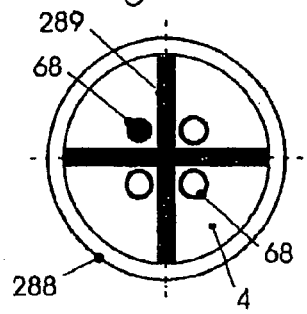
FIG. 30D illustrates an exemplary embodiment of an ALP assembly in cross-section with a cross-shaped internal element.

In order to complete the explanation with regard to FIGS. 30B and 30C, FIG. 30D illustrates an ALP cross-section 288, in which in the cylindrical inner space of the surrounding casing 290 is formed into four chambers by means of a cruciform part 289, in each of which there is provided a pressure-generating element 68 in the pressure-transmitting medium 4. Also herein, upon the ignition of only one element 68, there results an asymmetrical subprojectile or respectively fragment distribution.

Figure 31:
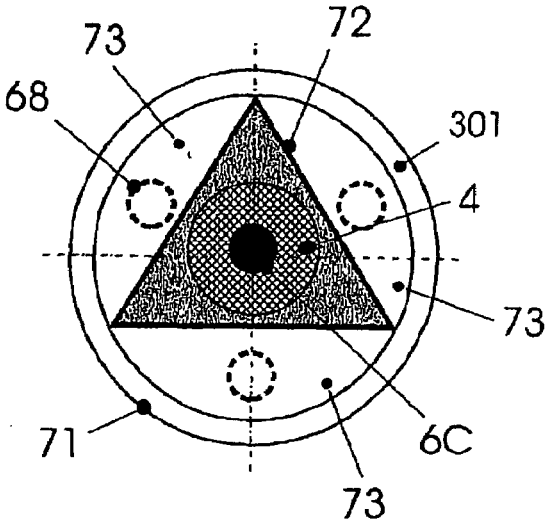
FIG. 31 illustrates a further exemplary embodiment of an ALP assembly with a central penetrator of suitable cross-section, which in itself is again constructed as a ALP.

In the ALP cross-section 71 illustrated in FIG. 31, in conjunction with FIG. 30B the central penetrator (or the central module) 71 has a triangular cross-section and is in itself an ALP. Between this central penetrator 72 and the casing 301 there can be found, for example, air, a fluid, liquid or solid material, a powder or a mixture or composition 73, referring to commentary with regard to FIG. 28, and in addition thereto further pressure generating bodies 68 in correspondence with FIG. 30B. The central pressure generating element 6E and the peripheral pressure generating elements 68 can also here be interconnected so as to achieve a specified effect. Naturally, they can also be separately activated. Thereby, for example, it is possible upon approach to a target to activate the lateral components, and the central ALP at a later point-in-time.

Figure 32:
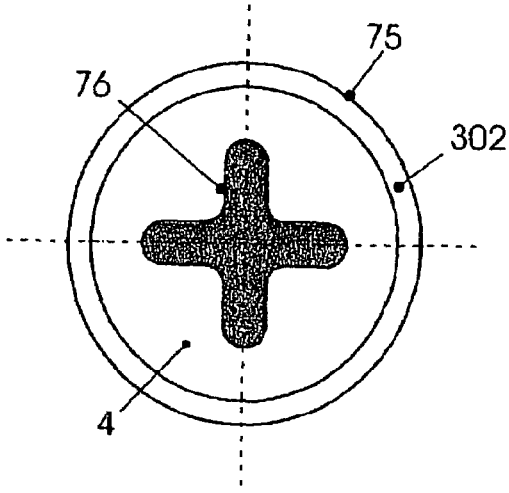
FIG. 32 illustrates an exemplary embodiment of a pressure generating unit with a non-circular cross-section.

The numerical simulation has verified that at a suitable selection of the pressure-transmitting medium, (for example, liquid, plastic such as PE fiberglass-reinforced materials, polymer materials, plexiglass and similar materials) also at an eccentric positioning of the pressure generating components, quite rapidly there takes place a pressure compensation or balancing which, in a first approximation supports a uniform disintegration of the casing or, respectively, a correspondingly uniform distribution of subprojectiles (for example, as shown in FIG. 46B). Thereby, it can also be quite comprehensible in particular for not rapidly pressure compensating materials through a suitable configuration of the pressure-generating components, to cause certain effects or desired disintegrations. Thus, for instance, FIG. 32 illustrates as an example a penetrator cross-section 75 with a pressure generating unit 76 with a non-circular cross-sectional shape.

By means of such types of configurations it is possible to achieve additional, partly at least especially outstanding effects. Thus, for example, it is contemplateable that through the cross-sectional shape of 76 there can be attained four cutting charge-like effects at about the circumference. This is particularly advantageous when there should be achieved controlled, locally limited extensive lateral effects. For a metallic pressure-transmitting medium with a lower balancing capability relative to the dynamic pressure field, with that type of cross-sectional form 76 there can be achieved, for example, intended specified disintegrations of the casing 302.

The heretofore illustrated exemplary embodiments each relate, in accordance with the complexity of the construction to preferably medium or large caliber sized penetrators. For warheads, rockets or large caliber ammunition (for example, for firing by means of howitzers or large caliber naval guns) technologically more complex solutions are possible, especially with separate (through a radio signal) triggered or fixedly programmed activation in predetermined preferred directions.

Figure 33:
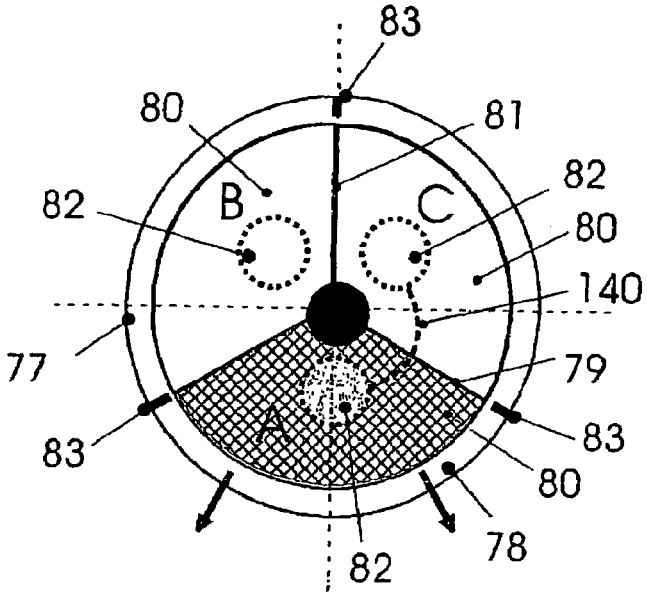
FIG. 33 illustrates an exemplary embodiment of an ALP projectile with a plurality (here three) unit (segments) across the cross-section, which for example are separately actuatable.

Thus, FIG. 33 illustrates an example of an ALP projectile (warhead) 77 with a plurality (here 3) unit 79 (cross-sectional segments A, B and C, for instance with a separating wall 81) which are distributed over the cross-section, which also functions separately presently as ALPs (pressure generating elements 82 in connection with a corresponding pressure transmitting medium 80), and which can be separately actuatable, or actuated among each other by means of a conduit 140 or through a signal (interconnected). The three segments are either completely separated or possess a common casing 78. This casing 78, for example, can provide for the support of a desired disintegration with matches or slits 83, recesses or other mechanically or possibly laser-generated or material-specifically-required changes along the surface.

It is understandable that such engagements into the surface of the fragment generating or subprojectile-forming or emitting casing 78 are basically possible for all illustrative exemplary embodiments in accordance with the present invention.

In a modification of the exemplary embodiment of FIG. 13, the ALP cross-section can, however, also be provided with an eccentrically positioned pressure-generating element such as for example, an explosive material cylinder 6C, as well as an internal and external pressure-transmitting medium and a fragment/subprojectile-generating or emitting casing. The inner components should preferably be consist of a good pressure distributing medium, for example, a liquid or PE (explanation with regard to FIG. 31). For the remainder, with regard to the two components, there is applicable the situation which has already been described with regard to FIG. 13. At a suitable design of the internal medium, it can also be interesting to achieve controlled asymmetrical effects. This can, for instance, be achieved in that the mass rich side of the inner pressure-transmitting medium acts as a damming for the pressure generating element 32, and thereby there is accordingly achieved a directional orientation (refer to herewith also to the commentary concerning FIGS. 30B and 33).

In that in the heretofore embodiments, explanations and descriptions with regard to the present invention there has been indicated an almost universally great spectrum of possibilities of variations on the basis of a multiplicity of examples, hereinbelow there is described in the following the designed-oriented view points. Thereby, besides the corresponding numerical simulations there also provided projectile concepts, which not only illustrate the power capability of the presented principle as an inert projectile, for example, as PELE penetrator, but also especially explain the capabilities of modular constructions under the combinations of different power carriers in an effective technologically ideally explanatory manner.

The damming assumes with pyrotechnic installations basically a great significance, inasmuch as it quite essentially influences the propagation of the shock waves and thereby also the achievable effects. The damming can be statically effected by means of constructive measures, or dynamically, meaning on the basis, of mass internal effects of suitable pressure-transmitting media. This is, in principle, also possible with liquid media, however, only first at extremely high impact or deformation velocities. Presently determined is the dynamic damming through the propagation speed of the sound waves, which determine the loading of the pressure-transmitting medium. Since, at the utilization of active laterally effective penetrators (projectiles in an especially measure for airborne bodies) there must be calculated also with relatively low impact speeds, the damming must be preferably carried out through technical installations (for example, closure of the tail end, separating walls). A mixed damming, meaning mechanical arrangements coupled with dynamic damming through rigid pressure-transmitting media, broadens the palette of its applications. A purely dynamic damming should have a prerequisite of extremely high impact velocities (for example, in a TBM defense).

Figure 34:
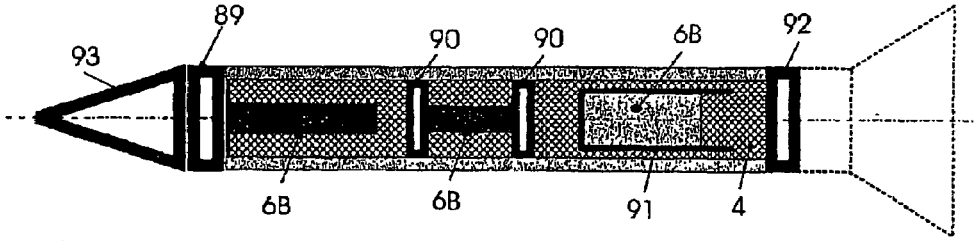
FIG. 34 illustrates different exemplary embodiments of dammings.

FIG. 34 illustrates examples for the damming of pressure generating elements during introduction into a penetrator. Thus, for example, the tip can be conceived as a damming element 93. Furthermore at the locations of a desired damming there can be advantageously inserted damming discs 90, or forward 89 and rearward closure disks 92. Such elements can also form the closure of hollow cylinders. As further of numerous forms which are conceivable for a partial or complete constructive damming of the pressure generating elements, for instance, in the form 6B (refer to FIGS. 6A through 6E and FIG. 7), there is also represented in FIG. 34 a damming element in the form of a cylinder 91 which is open at one side.

Figure 35:
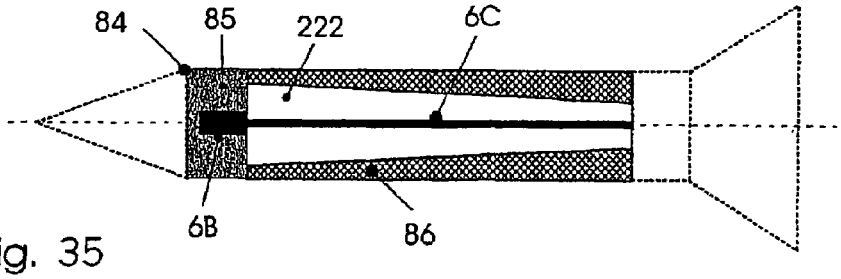
FIG. 35 illustrates an exemplary embodiment of a penetrator with a fragmentation head (concurrently damming for the initiation of triggering) and a conical jacket.

The type of damming which is of particular interest regarding projectiles or subpenetrators pursuant the present invention for the introduced pressure-generating elements, resides in the combination with a fragment module. Thus, FIG. 35 illustrates, as an example, an ALP projectile 84 with a fragment module 85 located behind the tip. This concurrently serves as a damming for the pressure generating element 6B and for the initiation of the triggering in the pressure generating element (explosives cord) 6C. As a further technical variant for such types of penetrators, there is illustrated in FIG. 35 a fragment or subprojectile-generating or emitting casing 86 with a conical internal space 222. It is also contemplatable that an external conically extending fragment casing (conical jacket) can be employed without any restriction in the described operative principle.

Figure 36:
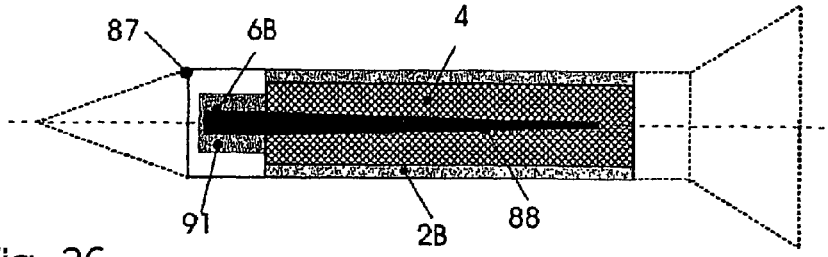
FIG. 36 illustrates an exemplary embodiment of a penetrator with damming (for the initiation of triggering) and conical pressure-generating element.

FIG. 36 illustrates a further example of a penetrator 87 with a damming module 91 (for example, for an improved triggering initiation), whereby the module 91 encompasses the pressure-generating element 6B, which itself extends into a lengthy pressure-generating element of conical configuration. With such types of conical elements 88 there can be generated in an extremely simple manner different acceleration forces across the length of the projectile or penetrator. It is also contemplatable to be able to combine a conical jacketing for example, corresponding to 86, with a conical pressure-generating element 88.

In the descriptions and explanations with regard to the present invention there have already been discussed liquid or quasi liquid pressure-transmitting media, in effect, materials such as PE, plexiglass or rubber as being especially interesting pressure transmitting media. With regard to a desired pressure distribution or shock wave propagation however, one is not in any manner required bound to these types of material, since by means of multiplicity of other materials there can be obtained throughout obtained comparable effects (refer to the already mentioned materials). However, inasmuch as particular fluids afford a wide scope for additional effects in the target, they represent an important element in the palette of possible active carriers. This is particularly applicable of the manner of effectiveness of an ALP in an inert type of utilization, which has already been described in detail in German DE 197 07 349C1.

Concerning the introduction of fluid or quasi-fluid media into an ALP, many constructive possibilities are available. These can, for example, be introduced in available and correspondingly sealed hollow spaces. Such types of hollow spaces can also be filled, for instance, with a grid like or foam like fabric, which can be saturated or filled in with the introduced fluid. A particularly interesting constructive solution consists of in that liquid media be introduced by means of correspondingly prefinished, and as a rule prior to assembly, filled container. However, it can also be interesting from the standpoint of technological utility, that such containers are only filled in case of utilization.

Figure 37:
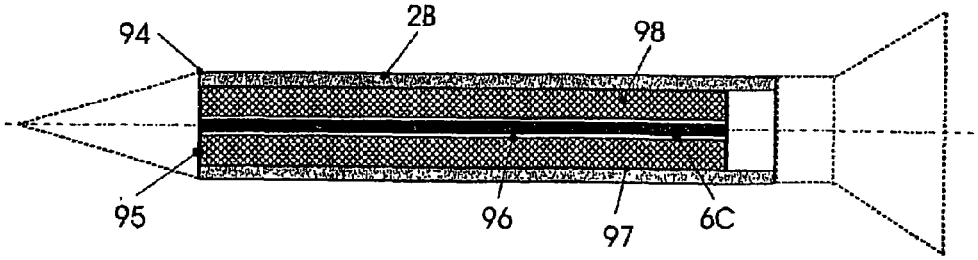
FIG. 37 illustrates an exemplary embodiment of an ALP projectile with a modular internal construction which, for example, is designed as a container for fluids.

FIG. 37 illustrates an ALP example 94 with modular internal construction (for example, as a container for fluids). In this example, the internal module 95 having the outer diameter 97 and the internal cylinder, respectively, the inner wall 96, are introduced into the projectile casing 2B (slid in, inserted turned in, vulcanized in, glued in). Through a manner of construction of that type, it is not only possible to be able to exchange individual modules or to insert them later on, but also the pressure-generating element 6C can be introduced only upon need. This type of construction is especially advantageously applicable for active arrangement in accordance with the present invention, inasmuch as the pressure generating element 6C (herein shown in a through extending form,) need extend only through a relatively small radial part of the penetrator, inasmuch as the disintegration is ensured by means of the pressure-transmitting medium 98, for example, a fluid. Thereby, the ALP need only be equipped at the point-in-time of its expected utilization with the pyrotechnic module 6C and, if required, the pressure-transmitting fluid medium 98 first filled upon utilization into the internal module, which is a particular advantage of this invention.

Basically, this example is stands for the possibility that projectiles can be modularly conceptuated pursuant to the present invention. Hereby, it is always possible to replace active laterally-effective modules, for example, with inert PELE-modules, or conversely. The individual inert or active module can thereby fixedly (in from or lockedly) connected or through suitable connecting systems releasably arranged. This will in a special manner facilitate an exchangeability of the individual module and thereby facilitate a multiplicity of combinations. Accordingly, such projectiles or airborne bodies can also at later points-in-time be easily correlated to changes in utilization scenarios, for example, at increasing combat measures, can always be newly optimized.

The same is applicable for the exchange of homogeneous components or tips. There must only expediently be considered hereby that an exchange of individual components will not cause the overall behavior of the projectile to change with respect to its internal and external ballistics.

Figure 38:
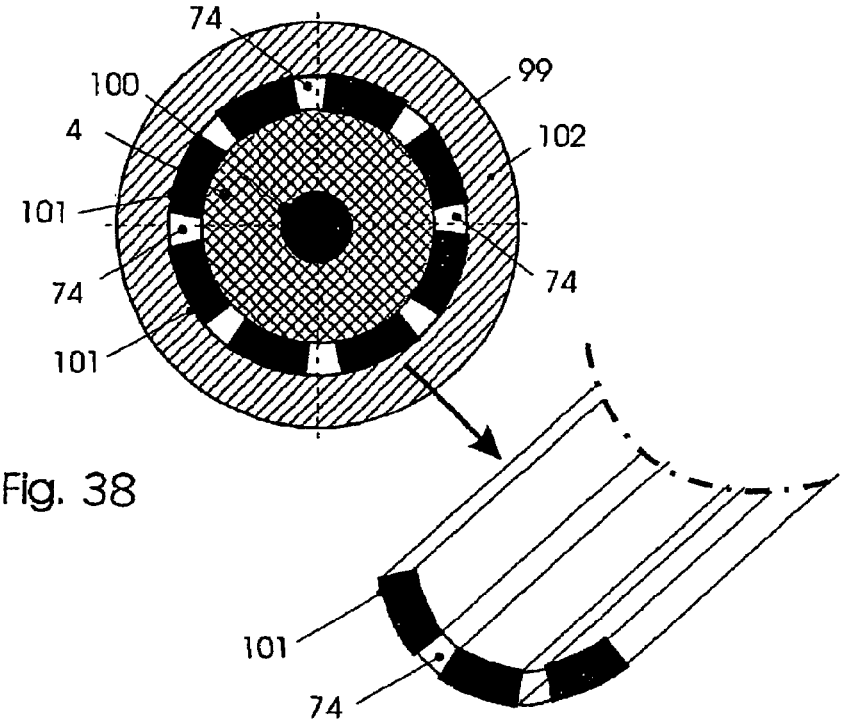
FIG. 38 illustrates an exemplary embodiment of an ALP assembly with a casing segments which, for example, are separately actuatable.

FIG. 38 illustrates an ALP example 99 with preformed casing structure fragments/casing segments in a longitudinal direction of the casing 102 and a central pressure-generating unit 100. Separation 74 between the individual segments 101 can be effected by means of the pressure transmitting medium 4 or as a chamber filled with a special material (for example, for shock damping and/or for connection of the elements) (for example, prefabricated jacket as its own, exchangeable module), as shown in the detail drawing. The interspaces 74 can also be hollow. Obtained thereby, for example, is a dynamic loading of the casing 102 which is extensively variable over the circumference. Through the changing in the width of the stage by the separation 74 and the thickness of the casing 102, in effect, through a suitable material selection, this effect can be varied. An interesting application variant is hereby obtained through the utilization of industrially widely available manufactured ball or roller bearing cages. Such types of modules can actually be arranged in multiple stages, in order to achieve a greater number of subprojectiles.

Figure 39:
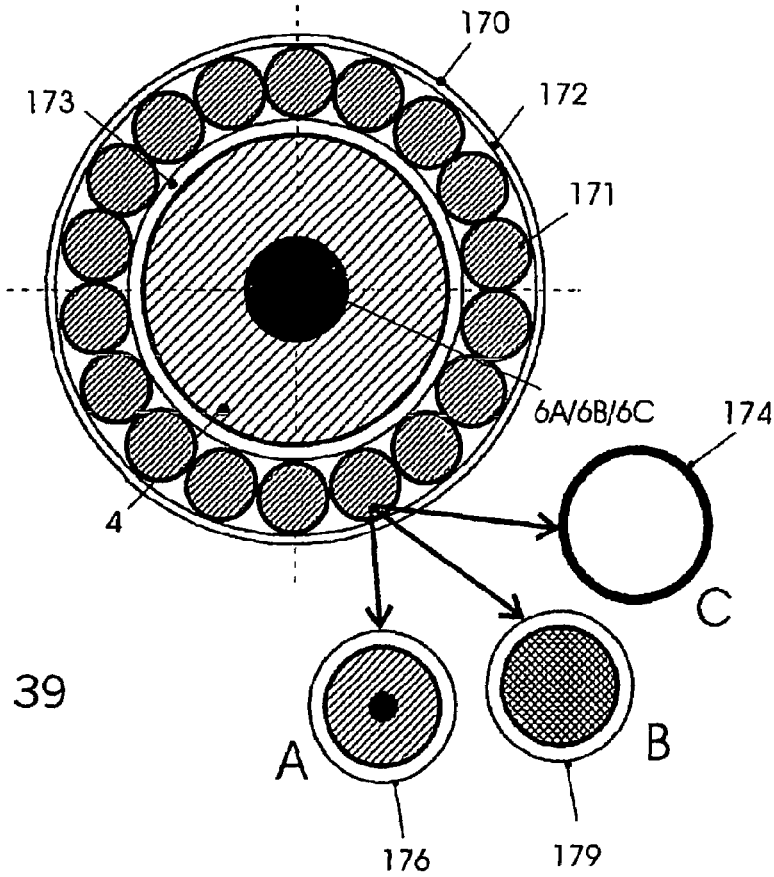
FIG. 39 illustrates an exemplary embodiment of an ALP assembly with a jacket consisting of sub-projectiles.

The consequent further development of the manner of producing a specified fragment/subprojectile covering of the combat area as is illustrated in FIG. 38 leads to solutions as illustrated for example in FIG. 39. Hereby this relates to an ALP projectile 170 with a jacket of prefinished fragments or subprojectiles 171 which are encompassed by an outer jacket (ring/sleeve) 172. On the inside, the bodies 171 retained either by an inner shell/casing 173 or a sufficiently rigid pressure-transmitting medium 4.

The components 171, especially for large caliber ammunition, or for warheads, or for rocket-propellant projectiles, allow for an usually great latitude with respect to the active bodies which are to be employed. Thus, for example, in the simplest case these can be constructed as slender cylinders from different materials. Furthermore, they can by themselves again be designed as ALP 176 (partially drawing A), somewhat in connection with the center pressure-generating element 6A/6B/6C, and/or in connections with each other, or in assembly or a combination of modular groups for the generation of a directed fragment/subprojectile emission. Moreover, the subprojectiles 171 can be constructed as PELE penetrators 179 (partial drawing B). Just as well these elements 171 can represent tubes 174 which are filled with cylinders of different lengths or, respectively different materials, with balls among other prefabricated bodies or fluids (partial drawing C).

The modular conception of a projectile or penetrator in conformance with the present invention facilitates that the active zones and the required auxiliary arrangements can be optimally positioned or expediently subdivided. FIGS. 40A to 40D hereby provide explanations for the example of a three-part projectile with a front, middle and rear zone.

Thus, in Thus in 40A the active laterally-effective component 6B is located in the tip or, respectively in the tip region of the projectile (tip-ALP) 103, with the auxiliary arrangements 155 in the rear zone. The connection 152 can be carried out by means of signal lines, radio or also by means of pyrotechnic installations (explosives cord).

In the example of FIG. 40B, the active part 6C with integrated auxiliary arrangements 155 in the tip region, is located in the middle zone of the projectile (middle segment-ALP) 104.

In the example in FIG. 40C, the active part 6B is in the tail end region of the projectile (tail end—ALP) 105, the auxiliary arrangements 155 are distributed among the tip and tail end, and connected with the active part 6B through signal lines 152.

FIG. 40D illustrates an example of an ALP projectile 106 with an active tandem arrangement (Tandem-ALP). The auxiliary arrangement 155 which is provided for the two active parts is hereby arranged in the middle region. Naturally the two active modules 6B of the tandem arrangement can also be activated separately or initiated. It is also possible to provide a logic junction, for example, by means of a delay element 139. The auxiliary arrangements 155 can also be arranged so as to be decentralized or remote from the center axis.

A further technically interesting variant in a modularly assembled projectile or penetrator is either a technically specified or dynamically effected projectile division/separating of the module. The dynamic division/separating can hereby be effected during flight, prior to impact, at the point in time of impact, or during penetrating through the target. The rear module can also be first activated within the interior of the target.

FIG. 41 illustrates an example for a projectile separation or respectively a dynamic division into individual functional modules. Hereby by means of a rear separating charge 251, the tailend can be expelled away. The charge 251 also serves for the pressure build-up in an active inert module 253 which is inertly conceived as a PELE penetrator. Concurrently, by means of the separating charge 251, there can be effected a tailend expulsion with further lateral effects which are produced by the tailend. As a result there is obtained an optimum utilization of the projectile mass in this part, inasmuch as the tailend is ordinarily considered to be as a "dead weight".

The second element for a dynamic separation is the front separating charge 254. Besides the separation, this can also serve for pressure generation. The tip can be concurrently sprung off and disintegrated. In this projectile, the two active parts are separated by means of an inert buffer zone or, respectively, a massive element, such as a projectile core or, respectively, a fragment part 252. Alternatively, the buffer element 252 can be equipped with a separating disc 255 with regard to the front active part (or rear part), or by itself by means of a ring-shaped pressure generating element 6D so as to achieve a lateral effect. Furthermore, there can also be provided an auxiliary tip 250 at the rear projectile part, which projects into the buffer element 252.

In FIGS. 42A through 42F there are illustrated examples for the configuration of a projectile tip (auxiliary tip).

Figure 42A:
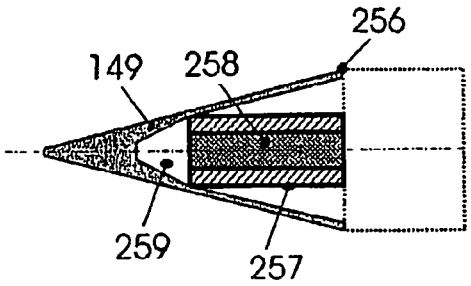
FIG. 42A illustrates an exemplary embodiment of a tip configuration of an ALP projectile with a PELE penetrator.

Thus FIG. 42A illustrates a tip 256 with integrated PELE module, consisting of the end ballistically-effective casing material 257 in combination with an expansion medium 258. In this embodiment the tip is further provided with a small hollow space 259, which at expediently on the function of the PELE module, especially at an inclined or sloping impact.

Figure 42B:
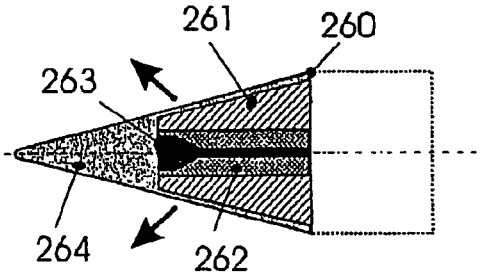
FIG. 42B illustrates a further exemplary embodiment of a tip configuration of an ALP projectile, with an ALP assembly.

FIG. 42B illustrates an active tip module 260 consisting of the fragment jacket 261 in connection with the pyrotechnic element 263 pursuant to FIGS. 6E and a pressure-transmitting medium 262. Here, it can also be expedient to melt the tip casing 264 with the fragment jacket 261. A still simpler construction is obtained by eliminating the pressure-transmitting medium 262. At an activation, the splinter form a down in the direction of the illustrated arrows, which not only achieves a corresponding lateral effect, but also for more increased inclined or sloping targets for an allows expectation of an improved impact behavior.

Figure 42C:
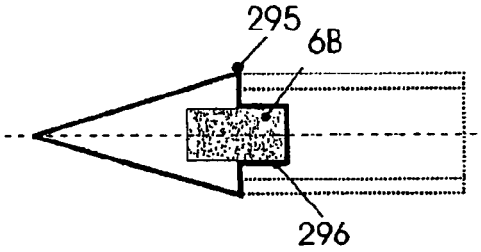
FIG. 42C illustrates an exemplary embodiment of a tip configuration of an ALP projectile as a solid active tip module.

FIG. 42C illustrates a tip configuration 295 in which a pressure-generating element pursuant to 6B projects partly in to the massive tip and into the projectile body, and is retained and/or dammed through the casing 296. In this manner, the tip 295 forms its own module which, for example, need be inserted only when need.

Figure 42D:
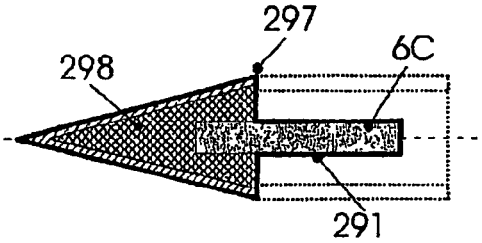
FIG. 42D illustrates a further exemplary embodiment of a tip configuration of an ALP projectile with a tip filled with an active medium.

A similar arrangement is illustrated in FIG. 42D, in which the tip 297 is constructed either hollow or is filled with an active medium 298 which achieves additional effect. The element 291 corresponds with the element 296 in FIG. 42C.

Figure 42E:
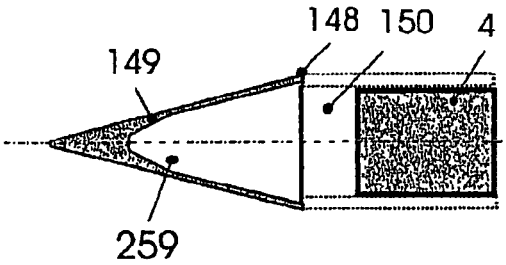
FIG. 42E illustrates an exemplary embodiment of a tip configuration of an ALP projectile as a tip with set back pressure-transmitting medium (hollow space)

The FIG. 42E illustrates a tip arrangement 148 in which a hollow space 150 is provided between the hollow tip 149 and the internal space of the projectile body or, essentially the pressure-transmitting medium 4. Into this hollow space 150, upon impact there can flow in target material, and thereby enable the achieving of a better lateral effect.

Figure 42F:
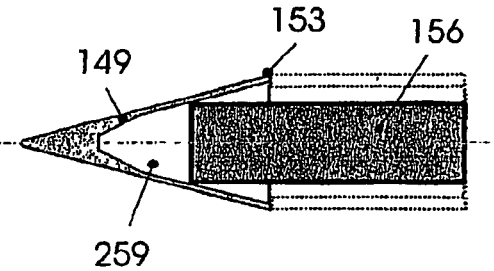
FIG. 42F illustrates an exemplary embodiment of a tip configuration of an ALP projectile as a tip with forwardly displaced pressure-transmitting medium.

In FIG. 42F, for a complete understanding there is shown a tip arrangement 153 in which the pressure-transmitting medium 156 projects into the hollow space 259 of the tip casing 149. Also this arrangement it can achieve a similar effect as does the arrangement pursuant to FIG. 42B, and effect a rapid initiation of the lateral acceleration sequence.

In the complex interrelationships which take place in connection with projectiles or penetrators pursuant to the present invention, the three-dimensional numerical simulation by means of suitable codes such as, for example, OTI-Hull with $10^6$ grid points, is an ideal auxiliary aid not only for representation of the applicable deformations or disintegrations, but also for the proof of the additive functions of multi-part projectiles. Simulations which are illustrated in which the framework of this application are implemented by the German-French Research Institute Saint Louis (ISL). This auxiliary aid off the numerical simulation has been already implemented through investigations in conjunction with laterally acting penetrators (PELE penetrators) (refer to DE 197 00 349 C1) and in the interim verified through a multiplicity of further experiments.

With the simulation, the dimension basically does not play any role. This is merely in the number of the necessary grid points and in advance sets a corresponding computer capacity. The examples were simulated with a projectile or respectively a penetrator external diameter of 30 to 80 mm. The degree of slenderness (length/diameter ratio L/D) consisted mostly of 6. Also this magnitude is of subordinate significance, since for the computations there should not be obtained quantitative but primarily qualitative results. As wall thicknesses there were selected 5 mm (thin wall thickness) and 10 mm (thick wall thickness). This wall thickness is, in a first instance, determinative for the projectile mass, and for cannon-fired ammunition is determined primarily from the power of the weapon, in essence, the attainable muzzle velocity for a specified projectile mass. For airborne bodies or rocket accelerated penetrators, the design spectrum is also significantly higher in this regard.

In as much as the examples, for the largest part, pertain to basic functional principle, which can b advantageously employed especially for large caliber ammunition or for suitably dimensioned warheads or rockets, there is also afforded a corresponding dimensioning. Understandably, however, all illustrative examples and all positions are not bound to a specific scale. It is merely the question of a sensible miniaturization of complex structures, also in conjunction with an eventual question ass to costs which must be considered during implementation of the invention.

As the material for the casing producing the fragment/subprojectiles, there was assumed tungsten/heavy metal (WS) of an average strength (600 $N/mm^2$ up to 1000 $N/mm^2$ tensile strength) and corresponding elongation or stretching (3 to 10%). Inasmuch as the deformation criteria which underlie this invention are always fulfilled, in order to ensure a desired disintegration, and one is not dependent upon a specified embrittling behavior, not only can one reach back to an extremely large material palette, but the spectrum within a family of materials is similarly quite extensive and is principally determined only through the stresses encountered during firing or other requisites on the part of the projectile construction.

Basically, for active arrangements in the context of the present invention, for the non-activated instance of utilization there are valid the same considerations and selection and/or design criteria as with PELE penetrators (as in DE 197 00 349C1). In addition thereto, as a decisive expanse relative to the PELE principle for an active laterally-acting penetrator, practically no restrictive criteria for the determination of material combinations need to be considered. Thus, for example, the pressure generation and the pressure propagation for a ALP is constantly afforded and can be set, in form, height and expansion. The function of the ALP is also independent of its velocity. This determines merely the penetrating power of the individual components in the direction of flight and for the laterally accelerated parts in combination with the lateral velocity, the effective impact angle.

Pursuant to the above embodiments it is completely possible to expand an internal cylinder possessing a high density (up to, for instance homogeneous heavy or hardened metal, or pressed heavy-metal powder) by means of a pressure-transmitting medium and thereby as a pressure transmitting medium to disintegrate and to radially to accelerate an outer jacket of lower density (for example, prefabricated structures hardened steel, or also a lightweight metal).

Furthermore, due to the previously specifiable pressure generation and the necessary pressure level, respectively extent of expansion, almost every suitable jacket construction, inclusive prefabricated subprojectiles, can be dependably radially accelerated. Thereby one is not subjected to the restrictions of a spontaneous disintegration with the restricted possibilities concerning desired fragment/sub-projectile velocity, but there can be realized extremely low lateral velocity in the magnitude of a few 10 meters per second, up to high fragment speeds (above 1000 meters per second) without necessitating, any special technical demand. Computations and experiments have shown that the necessary pyrotechnic mass is basically extremely small, so that the utilization in, a first instance, is determined by additive elements and desired effects. Therefore it is possible to proceed in that for penetrator masses in the range of 10–20 kilograms, minimum explosive material masses in the magnitude of 10 grams are adequate. For smaller penetrator masses, this minimal explosive material mass is correspondingly reduced further to values of 1 to 10 grams.

Thereafter, in FIGS. 43A to 45D there are shown three-dimensional numerical simulations for relatively simple assemblies, in order to physically, and mathematically cover the above-represented technical explanations and implemented examples in their basic points. In order to render more clearly the deformation of individual parts, especially that of the casing, the representations of the deformed parts are frequently rendered visible through the detonation of the produced gas and the pressure-transmitting medium when these do not cover the deformation process which is to be observed.

Figure 43A:
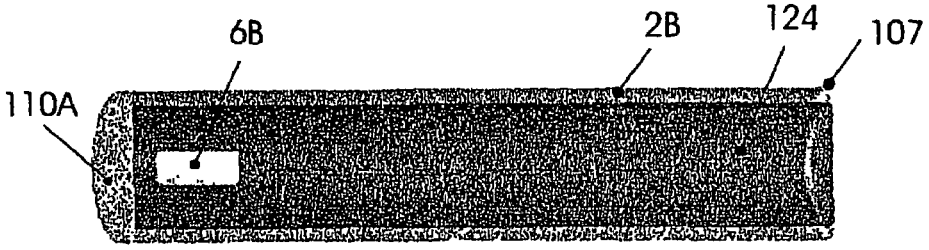
FIG. 43A illustrates a representation of a 3D simulation, which illustrates an ALP projectile pursuant to the invention with a compact pressure-generating unit and a liquid as a pressure-transmitting medium (corresponding to FIG. 4C) as well as an WS jacket.

Thus in FIG. 43A there is illustrated a simple ALP active assembly 107, constructed on the front side by means of a WS cover 110A closed-off hollow cylinder (60 mm outer diameter, wall thickness 5 mm, WS with high ductility) with the casing 2B (refer to FIG. 1B), and a compact acceleration/pressure generation unit 6B with an explosive material mass of only 5 grams. As the pressure-transmitting medium there was employed liquid medium 124, (here water) with a construction pursuant to FIG. 4A.

Figure 43B:
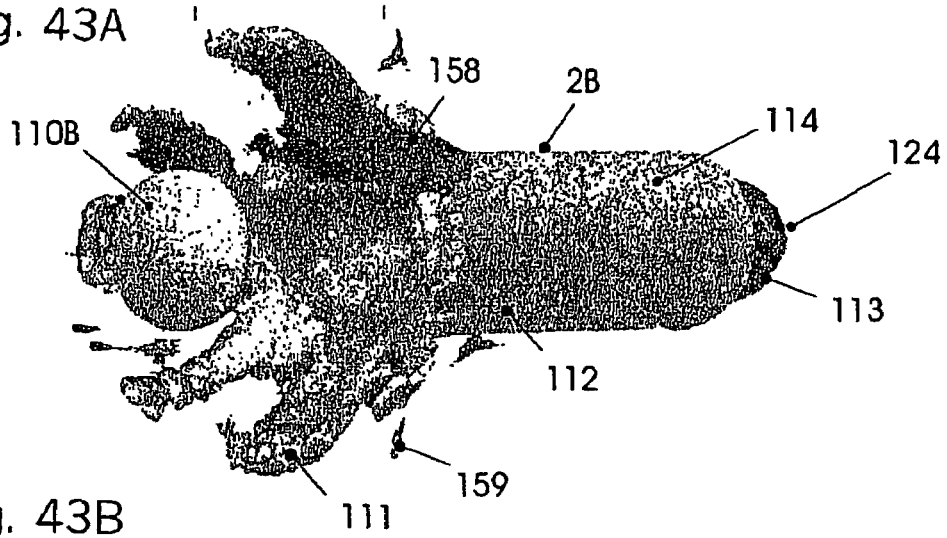
FIG. 43B illustrates a representation of a 3D simulation of a dynamic disintegration of the arrangement pursuant to FIG. 43A, 150 μ seconds after triggering.

FIG. 43B illustrates the dynamic disintegration at 150 microseconds (μs) subsequent to the ignition of the explosive charge 6B. For the present configuration, there are formed six large casing fragments 111 and a series of smaller fragments. Similarly, easily recognizable is the deformed cover 110B which is accelerated in an axial direction. Exiting at the rear side of the cylinder is the accelerated liquid pressure-transmitting medium 124 (exit length 113). In the forward region the pressure-transmitting medium 158 contacts against the inside of the casing fragments, a portion 159 has exited. Furthermore, at this point in time the beginning fissures 112 and the already produced longitudinal fissures 114 indicate that already for an this extremely low explosive material mass the ductile selected casing wall completely disintegrate. Concurrently, this deformation image documents that the problemless functioning of a construction of this type in accordance with the invention.

FIG. 44A illustrates a similar penetrator as is shown in FIG. 43A. The dimensions of the ALP 108 remain unchanged, merely the pressure-generating element was modified. It relates to a thin explosive material cylinder 6C (an explosives cord according to FIG. 4F.

Figure 44B:
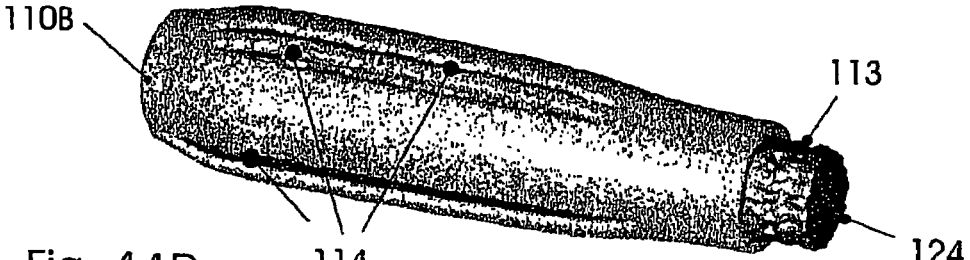
FIG. 44B illustrates a representation of a 3D simulation for a dynamic disintegration of the arrangement pursuant to FIG. 44A, 100 μ seconds subsequent to triggering.

FIG. 44B illustrates the dynamic deformation of the ALP 108 at already 100 μs after to the ignition of the charge 6C. The corresponding pressure propagation and pressure distribution was already explained with regard to FIG. 10.

Furthermore, the influence of diverse materials as pressure-transmitting media was investigated. The selected assembly 109 pursuant to FIG. 45A corresponds to that of the 2D simulation in FIG. 11, consisting of a WS-casing 2B (with a 60 mm outer diameter) with a front damming 110A at one side thereof in the region of the thicker explosive material cylinder 6B. The pressure-transmitting medium surrounds the pressure generating elements 6B/6C.

Figure 45A:
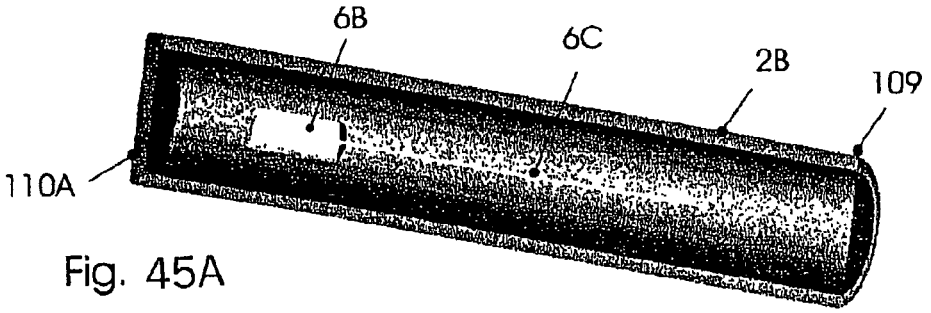
FIG. 45A illustrates a representation of a 3D simulation of a principal ALP assembly according to FIG. 4H, with diverse pressure-transmitting media.
Figure 45B:
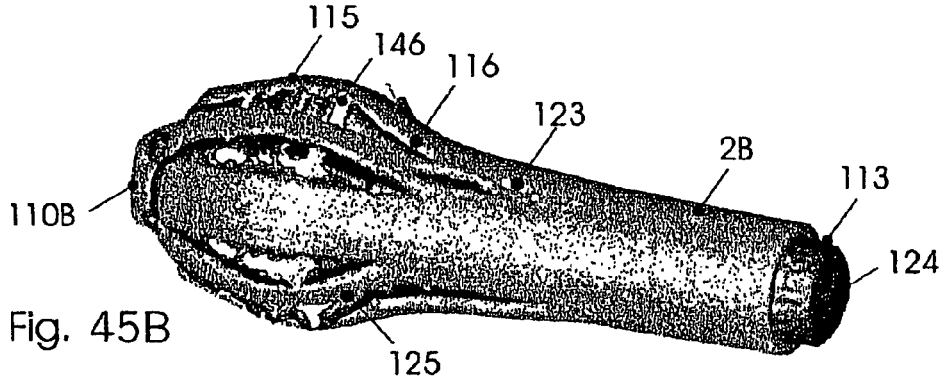
FIG. 45B illustrates a representation in a 3D simulation for a dynamic disintegration of an arrangement pursuant to FIG. 45A, 150 μ seconds after triggering whereby a liquid is utilized as a pressure-transmitting medium.

FIG. 45B illustrates the dynamic casing expansion with a liquid (water) 124 as the pressure-transmitting medium 150 μs after the ignition of the pressure-generating charge 6B. The accelerated casing segment 115, the ripping open casing segment 116 and the reaction gases 146 can be readily recognized. The liquid medium 124 is only slight, accelerated, meaning, with the discharge length 113. The beginning fissure formation 123 has already propagated up to one-half of the entire casing length.

Figure 45C:
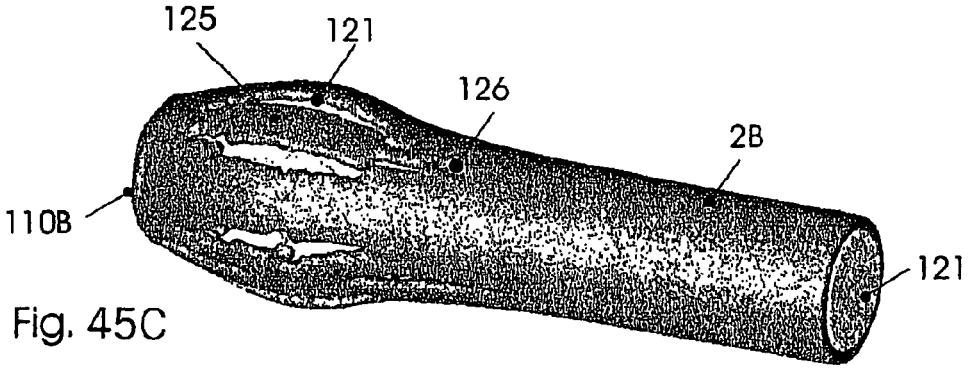
FIG. 45C illustrates a representation of a 3D simulation of a dynamic disintegration of an arrangement pursuant to FIG. 45A, 150 μ seconds subsequent to triggering, whereby a polyethylene (PE) is utilized as pressure-transmitting medium.

In FIG. 45C, with Plexiglass was calculated as being the pressure-transmitting medium 121. The dynamic expansion 125 of the casing 2B and the beginning fissure formation 126 at 150 μs after ignition is somewhat lower than in the example pursuant to FIG. 45B. The discharge of the medium 125 rearwardly is extremely slight.

Figure 45D:
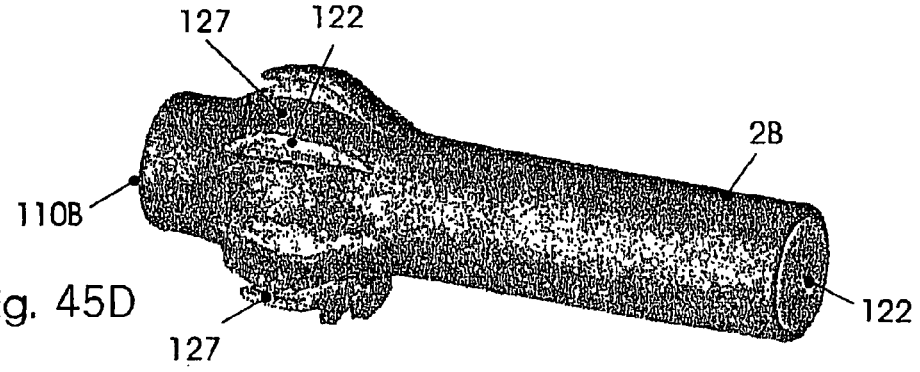
FIG. 45D illustrates a representation of a 3D simulation for a dynamic disintegration of an arrangement pursuant to FIG. 45, 150 μ seconds subsequent to triggering, whereby aluminum is utilized as the pressure-transmitting medium.

For the numerical simulation pursuant to FIG. 45D, aluminum was employed as the pressure-transmitting medium 122. The deformation of the casing 2B at 150 μs after ignition if very defined in the region of the pressure generating element 6B. The casing fragments 127 are locally already intensely expanded. A fissure formation in the longitudinal direction of the casing 2B in contrast therewith (FIGS. 45B and 45C) has not yet occurred, and the discharge of the medium 122 rearwardly is negligibly slight.

In FIG. 46A there is presented an ALP 128 with an eccentrically positioned pressure-generating element 35 in the form of a slender explosive material cyclinder. In this arrangement there was effected an opposite positioning of liquid (water) 124 and aluminum 122 as the pressure-transmitting medium.

Thus, in FIG. 46B there is shown the dynamic disintegration of this arrangement pursuant to FIG. 46A with the liquid 124 as the transmission medium at 150 μs after ignition. There is not obtained any significantly different distribution of the casing fragments 129, and also no decisively different fragment velocities at the circumference.

FIG. 46C illustrates the dynamic disintegration of the arrangement according to FIG. 46A with aluminum 122 as transmitting medium at 15 μs after ignition. Here the original geometry also shows itself in the disintegration picture. Thus, the case fragment 130 are intensely accelerated at the contacting side by the pressure generating element 35, and the casing is intensely fragmented at this side, whereas the lower side which faces away from the charge 34 still forms a shell 131. At this point in time in the computation there can be recognized the inside merely beginning constructions (fissures) 132.

Figure 47A:
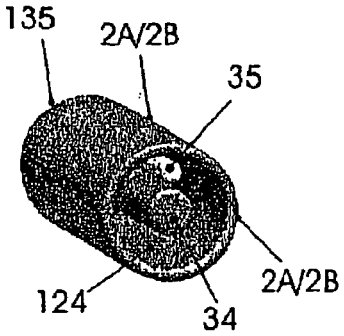
FIG. 47A illustrates a representation of a 3D simulation of an ALP assembly with a central penetrator and with an eccentrically positioned pressure generating element (cylinder)

FIG. 47A illustrates an ALP 135 with a central penetrator 34 consisting of WS, of the for the WS casing mentioned quality, and with an eccentrically positioned pressure-generating element 35. As the simulated deformation image at 150 μs after ignition illustrates in FIG. 47B, notwithstanding the selected liquid 124 as the pressure-transmitting medium, there is obtained a clear distinction with respect to the fragment or subprojectile distribution over the circumference. Thus, the casing fragments 136 are more intensely accelerated on the side towards of the pressure-generating element 35. Towards the front, there is partially recognizable the accelerated liquid medium 159.

The comparison which FIG. 46B renders evident, in that the difference in the deformation image is due to the central penetrator 34. It acts, as already mentioned, apparently as a reflector for the pressure waves which emanate from the explosive material charge 35. Thereby by means of the simulation there is provided the proof that with such type of arrangement there can be achieved controlled directionally-dependent lateral effects across geometric designs. It is also significant that the central penetrator is not destroyed, but is merely displaced downwardly, in effect, deviating from its original trajectory.

Figure 47B:
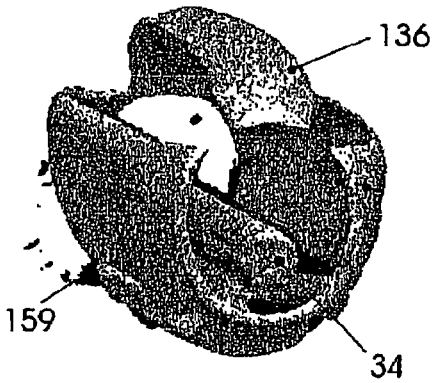
FIG. 47B illustrates a representation of a 3D simulation of a dynamic disintegration of an arrangement pursuant to FIG. 47A, 150 μ seconds subsequent to triggering.

From FIG. 47B there can also be derived that, in an above all technologically undisputable variant, it is basically possible that through a controlled activation of one or more charges 34 which are eccentrically distributed about the circumference, the central penetrator still can be imparted in proximity to the target a corrective directional impulse.

The previously illustrated simulation examples interlink the already described individual components as already described with regard to FIGS. 2A, 2B, 4B, 4C, 4H, 6E, 12, and 40A–40C relates to a spin or aerodynamically-stabilized ammunition concept, which especially in conjunction with the present invention always address and basic ammunition module concurrently evidence: tip, active laterally effective module, PELE components (to the extent as not combined with the active component), and massive or, respectively, homogenous components. Such constructions are illustrated expediently by the following FIGS. 48A–48C.

FIG. 48A relates to a three part modular spin stabilized penetrator 277, constituted of tip module 278, a passive (PELE) or massive module 279 and an active module 280. The auxiliary arrangements can be located, for example, in the part 282 encompassing the active module, in the tip module 278, or in the tail end region, or as already described can be divided. The active module 280 is preferably closed off at its tail end with a damming plate or disc 147.

In FIG. 48B there is, for example, illustrated a four-part, modular, aerodynamically stabilized projectile 283. It consists of a tip module 278, an active module 280 with a damming disc 147 against the, for example, hollow or inadequately dammed tip, a PELE module 281, and a tail end portion 284 which is homogeneous and is connected thereto. Thereby are thus listed the essential projectile penetrator or warhead components, which can occur in complex built-up active bodies. However, it is understood in itself that one intends, pursuant the range of utilization, to conceptualize a simplest possible variant. Hereby, it is of surely great advantage that a plurality of module assumed dual or multiple functions.

Figure 48C:
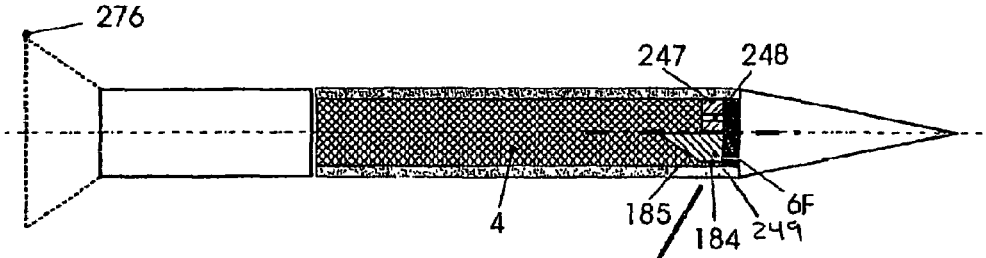
FIG. 48C illustrates an exemplary embodiment of an ALP projectile with cylindrical or conical portion in the active part for an intensive lateral acceleration.
Figure 48D:
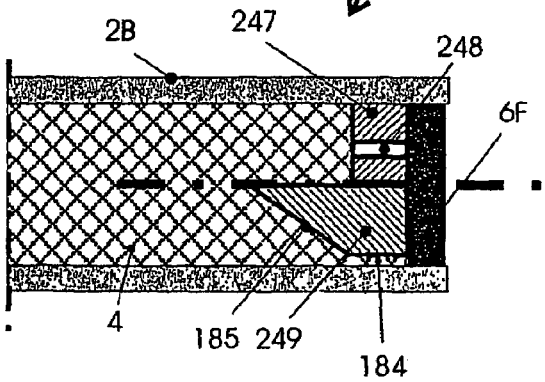
FIG. 48D illustrates an enlarged representation of the cylindrical/conical part of the ALP projectile of FIG. 48C.

In FIG. 48C there is illustrated a projectile 276, in which cylindrical 247 or piston like part 249 is located in the active part behind the disc-shaped pressure-generating charge 6F. The cylinder 247 can also be provided with one or more bores 248 for pressure balancing or, respectively, for pressure-transmitting (see detail drawing FIG. 48D).

The piston like part 249, for instance can possess a spherical or a conical shape 185 on the side facing the pressure-transmitting medium 4 (detail drawing FIG. 48D), so as to during the pressure introduction, the medium 4 in the region of this cone is laterally accelerated more intensively. That type of piston for densification or for subjection of a medium to pressure is described for example in Patent EPO 146 745 A1 (FIG. 1). In the contrast with the therein provided mechanical acceleration through the impacted ballistic hood and, possible (upon an inclined sloping impact) intermediately connected auxiliary means and they thereby raised question of a problemless axial movement initiation, at a pressure subjection by means of a pyrotechnic module, the piston 249 is always axially accelerated. Moreover, it can also be encompassed by the medium 4 (in effect not the entire cylinder will not be filled out). As a result, the produced pressure can expand in the medium 4 through the forward annular gap 184 between the outer casing 2B and the piston 249.

For a verification of the invention there is in the interim carried out in the ISL were also experiments on a scale of 1:2 in completion of the numerical simulations for a basic proof of the functionability of an arrangement in accordance with the present invention.

Figure 49A:
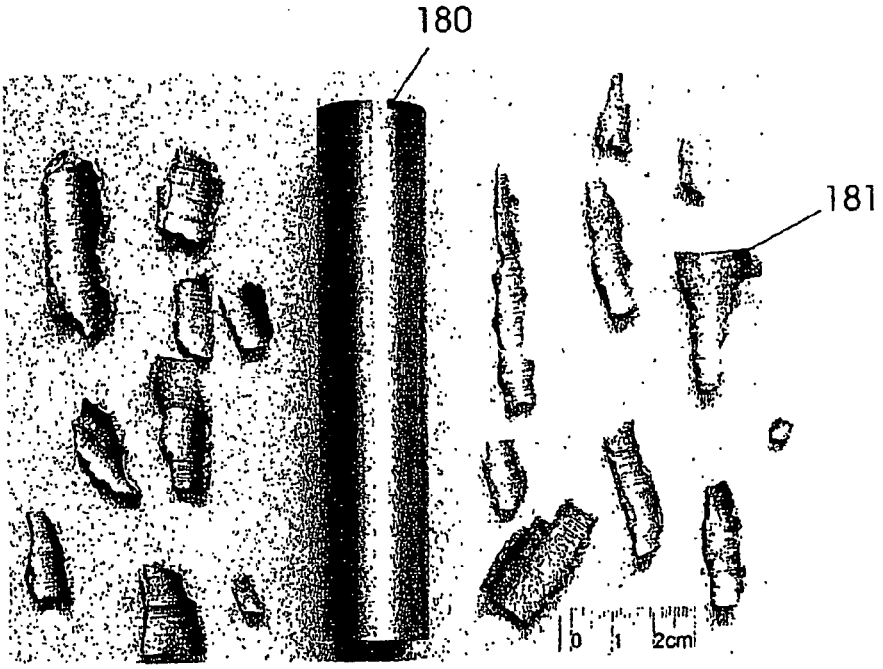
FIG. 49A illustrates a representation of an experiment which illustrates an WS cylinder jacket prior to and subsequent to the active disintegration.

As an example, FIG. 49A illustrates the original penetrator casing 180 (WS, diameter 25 mm, wall thickness 5 mm, length 125 mm) and a part of the found fragment 181.

Figure 49B:
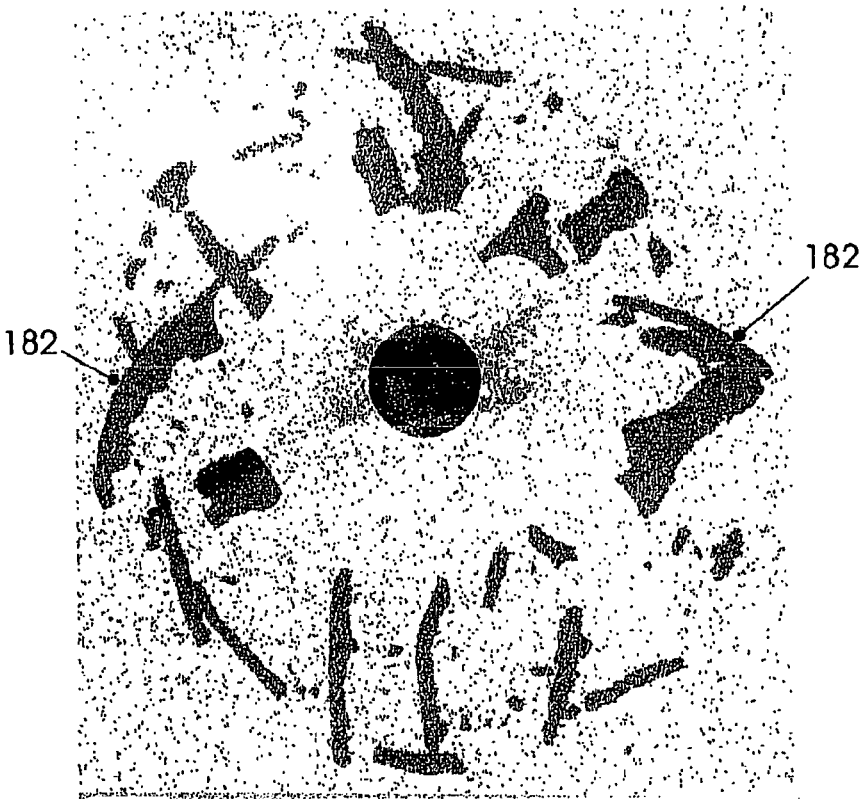
FIG. 49B illustrates a double-illuminated x-ray flash image of the accelerated fragments.

FIG. 49B illustrates a dually illuminated x-ray flash image, approximately 500 μs subsequent to the initiation of a triggering impulse, with the fragments 182 shown uniformly accelerated over the circumference.

Water was employed the pressure-transmitting medium. For pressure generation there was used a explosives cord-like (diameter of 5 mm) detonator simply inserted into the liquid, possessing a 4 gram explosive material mass. The mass of the WS casing consisted of 692 gram (WS with a density of 17.6 gram per cubic centimeter), the mass of the liquid pressure-transmitting water having a density of $\rho=1$ Gram per cubic centimeter) consisted of 19.6 gram. The ratio of explosive material mass (4 grams) to the mass of the inert pressure-transmitting medium (19.6 gram) was thus 0.204; and the ratio of the explosive material mass (4 gram) to the inert projectile mass (casing+water=7111.6 gram) consisted also of 0.0056, corresponding to a component of 0.56% of the inert total mass. The values for these ratios are still reducing for larger projectile configurations, or are increasing for smaller projectiles.

The implemented experiment proved that an inert penetrator with a ratio relative to the overall mass by extremely low pyrotechnic mass of the pressure-generating arrangement was about 0.5 to 0.6% of the inert total mass of the penetrator at a corresponding dimensioning of the projectile casing, and the inner space filled with a suitable inert pressure transfer medium allows itself to be laterally disintegrated by means of a pressure pulse initiated by a triggering signal of a detonator.

The implemented experiment is only one example for a possible embodiment of an ALP projectile. From the basic principle of the invention, however, there are no restrictions to the configuration or to the end ballistically effective casing and its thickness or respectively its length. Thus, the laterally effected disintegration principle functions for thick-walled casings (for example, a WS wall thickness for a penetrator diameter of 30 mm), as well as for extremely thin casings (for example, 1 mm titanium wall thickness for a penetrator diameter of 30 mm).

With respect to the length, it is applicable that the ALP principle similarly functions as well for all conceivable and ballistically sensible values. For example, the length/diameter ratio (L/D) can lie within the range of between 0.5(disc-shape) and 50 (extremely slender penetrator).

For the ratio of the chemical mass of the pressure generating-unit relative to the inert mass of the pressure-transmitting medium, there is basically only the restriction to the extent in that the produced pressure energy be assumed in a sufficient measure and suitable timed succession from the pressure-transmitting medium and then further transmitted to the encompassing casing. As a practional upper limit for a small projectile configuration is a value of 0.5.

For the ratio of (chemical) mass of the pressure generating unit to the inert total mass of the penetrator/projectile/airborne body, due to the implemented 3-D simulations there were determined extremely small values within the range of 0.0005 up to 0.001, during the experiment a value of 0.0056. From this there can be prognosticated that even for extremely small projectile configurations, in which the active laterally effective principle can still be sensibly introduced, a value of 0.01 is not exceeded.

In the invention there is obtained a multiple configuration of an active laterally effective penetrator ALP (projectile or airborne body) with an integrated disintegration arrangement, the last finally signifies that for all conceivable scenarios of utilization there is necessary only one projectile principle of the inventive configuration (universal projectile).

In FIGS. 50A through 53 there are illustrated a series of examples for projectiles with one or more active bodies. In these examples thus relates to aerodynamically stabilized projectiles, however, in considerations can also be applied to spin-stabilized projectiles. Hereby, naturally there may be expected, due to the stabilization and the thereby connected limited constructive lengths, various constructional limitations.

Figure 50A:
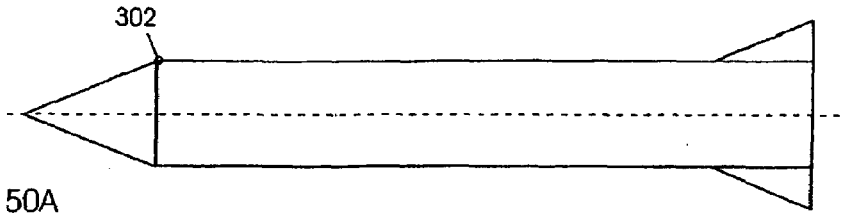
FIG. 50A illustrates an aerodynamically stabilized projectile, designed as an active effective body.

FIG. 50A is an aerodynamically stabilized projectile 302 in a most general form, which in its entirety should be designed as an active effective body.

Figure 50B:
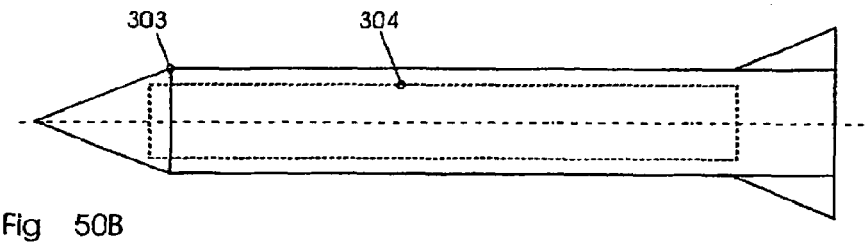
FIG. 50B illustrates an example of an aerodynamically stabilized projectile with a centrally positioned active effective body.
Figure 51:
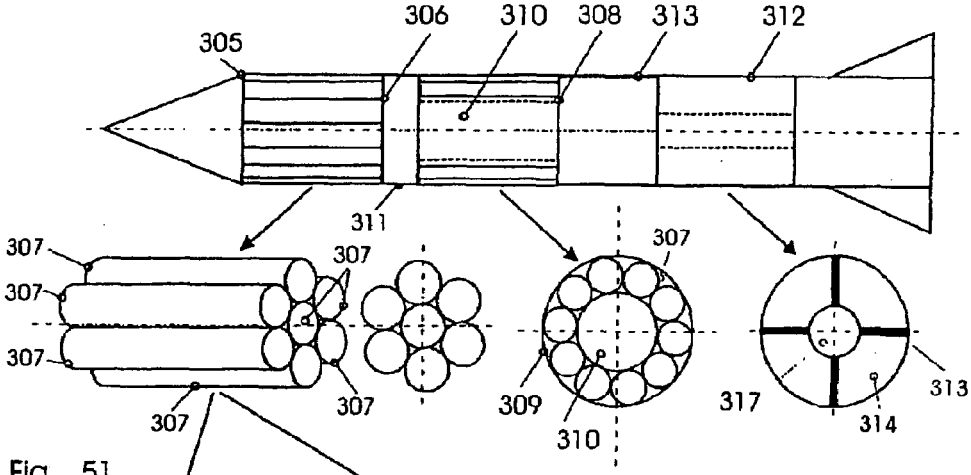
FIG. 51 illustrates and example of an aerodynamically stabilized projectile with plurality of active effective bodies.

FIG. 50B illustrates a corresponding example for an aerodynamically stabilized projectile 303 with an independently effective, centrally positioned active effective body 304 pursuant to the invention. For the configuration of this body 304, in FIGS. 15 through 29 there already provided a series of examples.

In FIG. 51 there is again represented a aerodynamically stabilized projectile example 305 with a plurality of active effective bodies or respectively projectile stages with the corresponding cross-sections. In detail this hereby relates to one stage 306 with a bundle of active effective bodies 307. In this connection there is pointed out the exemplary embodiments in FIGS. 26 and 27. Pursuant to an intermediate stage 311 there follows a stage 308 with a crown or respectively a ring bundle 309 of active effective bodies 307. In this example the stage 308 possesses a central unit 310. This, in turn can be either constructed again as an active effective member pursuant to the already described examples, or can also represent a central positionally inert penetrating body. A further possibility consists of in that this central body 310 can have associated therewith specified, for example pyrophoric or pyrotechnic active mechanisms. Pursuant to the intermediate stage 313, which for example can contain control or respectively triggering elements, there follows a further example for an active stage 312. This is formed from a bundle of 4 active segments 314 (refer to FIG. 30B). This stage contains here a central unit 317 for which there can be applicable the considerations mentioned with regard to the central body 310. This stage can also serve for the lateral acceleration of the active segments 314. Naturally, such stage can also be eliminated. A further example for a segmented stage was also illustrated already in FIG. 33.

Figure 52A:
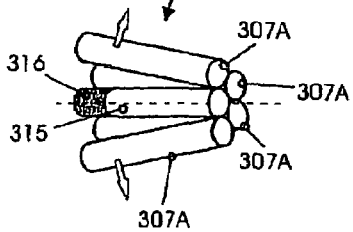
FIG. 52A illustrates an asymmetric opening of an active with a bundle of active effective bodies.
Figure 52B:
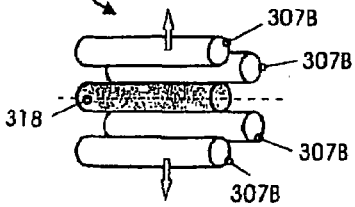
FIG. 52B illustrates an asymmetrical opening of an active stage with a bundle of active effective bodies.

FIGS. 52A and 52B illustrate two examples for the lateral acceleration of active effective bodies. Thus, FIG. 52A illustrates the fan-shaped opening of a stage 306 which is constituted of a bundle of active effective bodies 307A. For this purpose, the central body is replaced by a unit 315 with an accelerating module 316 in the forward region. Through this arrangement of the pyrotechnic unit 316 the ring constituted of active effective bodies will open in a fan shape. FIG. 52B illustrates a corresponding arrangement in which the central accelerating module 318 causes a symmetrical lateral acceleration of the active effective body 307B.

Figure 53:
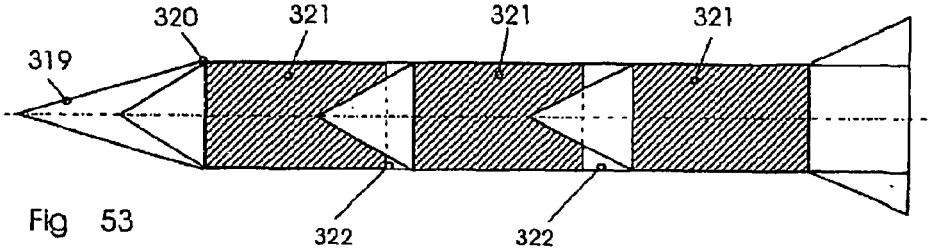
FIG. 53 illustrates an example of an aerodynamically stabilized projectile with a plurality of excessively connected active subprojectiles.

FIG. 53 illustrates a projectile 320 with a plurality of active, axially sequentially connected subprojectiles 321. Arranged between the active subprojectiles are intermediate or separating stages 322. The external ballistic hood 319 can be formed either by the tip of the first projectile 321, or can be connected ahead thereof as a separate element. The control or, respectively, triggering can be effected centrally or separately for each individual subprojectile 321. It is also possible that the individual projectiles can be separated prior to reaching of the target.

Figure 54:
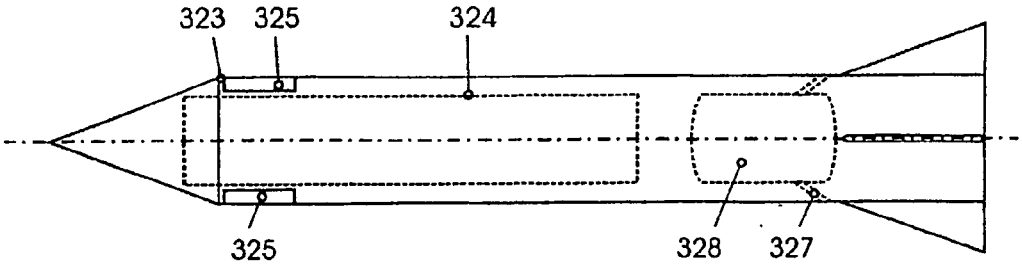
FIG. 54 illustrates an end phase guided, aerodynamically stabilized projectile with an active effective body.

FIG. 54 illustrates an end phase guided, aerodynamically stabilized projectile 323 with an active effective body 324. As examples for an end phase guidance there are shown pyrotechnical elements 325 and a nozzle arrangement 327 which is supplied by a pressure container 328.

Figure 55A:
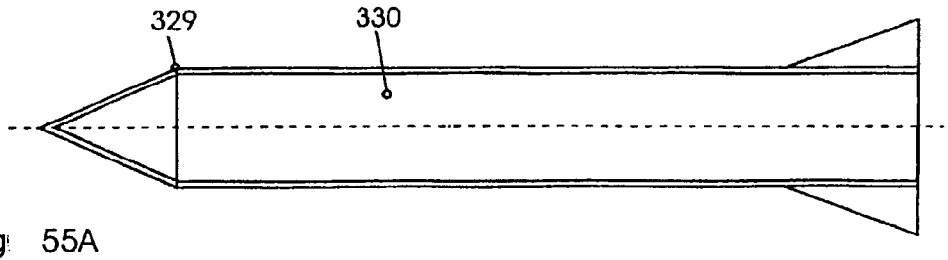
FIG. 55A illustrates a practice projectile, formed as an active body.
Figure 55B:
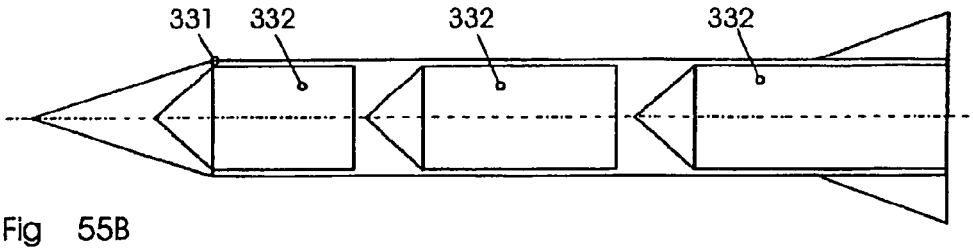
FIG. 55B illustrates an example for a practice projectile with a plurality of modules, singularly designed as an actively disintegratable, low effective body.

In FIG. 55A, a practice projectile 329 is illustrated as an active, disintegratable body 330. FIG. 55B illustrates an example for a practice projectile 331 with a plurality of modules 332, similarly designed as an active disintegratable low effective body.

Figure 56:
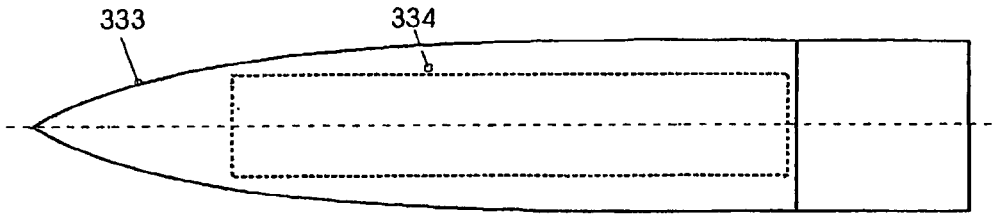
FIG. 56 illustrates a warhead with a central active effective bodies.
Figure 57:
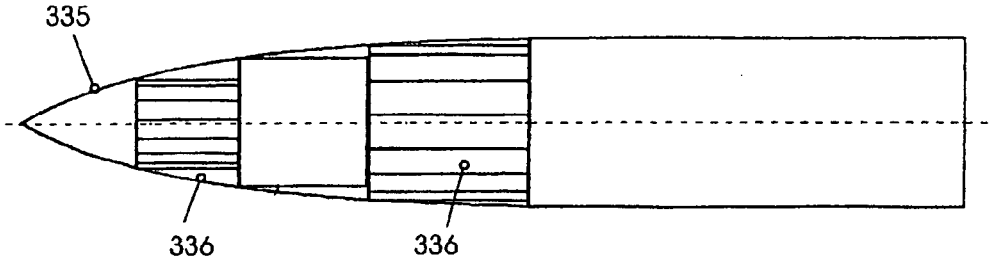
FIG. 57 illustrates an example of a warhead with a plurality of active effective stages.

FIGS. 56 and 57 illustrate warheads with one or more active effective bodies. Thus, in FIG. 56 there is represented a warhead 333 with a central active effective body 334. FIG. 57 illustrates as an example a warhead 335 with a plurality of active effective stages 336, here constructed as an active body bundle, approximately as in FIG. 51.

Figure 58:
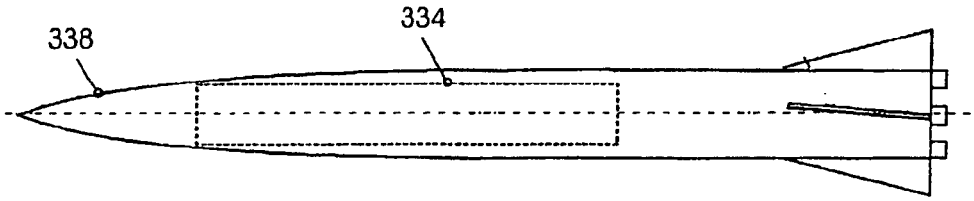
FIG. 58 illustrates a rocket-accelerated guided airborne body with an active effective body.
Figure 59:
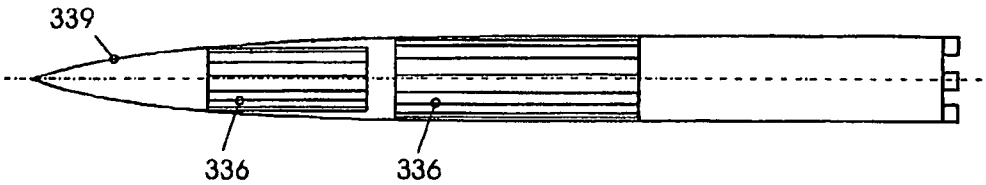
FIG. 59 illustrates an example of a rocket-accelerated airborne body with a plurality of active effective body stages.

FIGS. 58 and 59 illustrate a guided rocket-accelerated airborne bodies with one or more active effective bodies pursuant to the invention. Thus, in FIG. 58 is represented a rocket-accelerated guided airborne body 338 with an active effective body 334. FIG. 59 illustrates an example for a rocket-accelerated airborne body 339 with a plurality of active effective body stages 336.

FIGS. 60 through 65 illustrate guided or unguided underwater bodies (torpedoes) with one or more active effective bodies. Hereby, in FIGS. 60 through 63 there are schematically illustrated classic torpedoes with and without guidance, in FIGS. 64 and 65 high speed torpedoes which due to the high cruising velocity will travel practically within a cavitation bubble.

Figure 60:
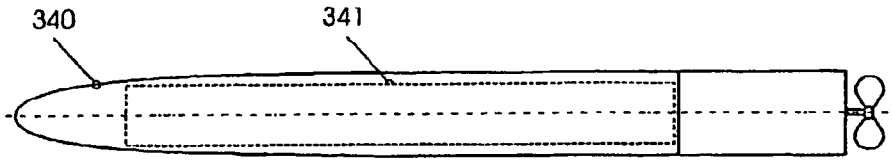
FIG. 60 illustrates an underwater body (torpedo) with an active effective body.
Figure 61:
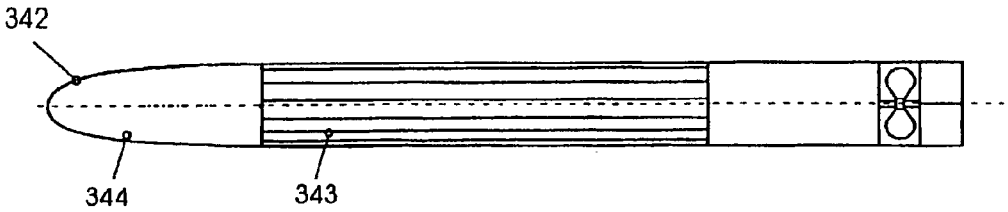
FIG. 61 illustrates an example for a torpedo with an active effective body bundle.

FIG. 60 illustrates a unguided underwater body 340 with an active effective body 341, FIG. 61 a guided torpedo 342. It possesses, in this example, a head 344 which, for example, can be filled with a pyrophoric material so that the subsequent stage 343 of active effective bodies can be introduced into the interior of a target with a corresponding spreading effect. It is also contemplatable that the head 344 is constructed of an inert armor-rupturing material in order to achieve an extremely high penetrating power as needed.

Figure 62:
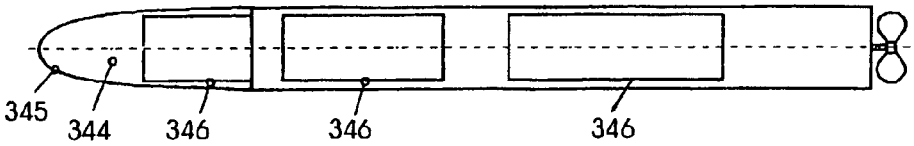
FIG. 62 illustrates an example of a torpedo with a plurality of sequentially connected active stages.
Figure 63:
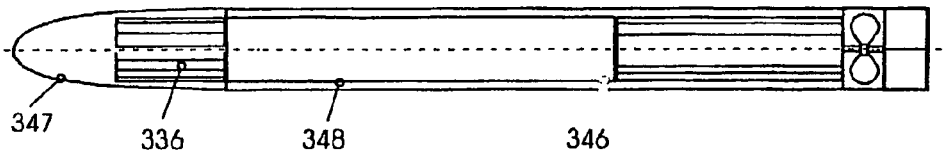
FIG. 63 illustrates a further example of a torpedo with a plurality of sequentially connected active stages.

FIG. 62 illustrates the schematic representation of an again unguided torpedo 345 with a plurality of successively connected active stages 346, for example, as described in the preceding examples. In FIG. 63 there is represented a further example for a underwater body 347 with a plurality of successively connected active effectives stages 336 and 346. Located between these active stages with active body bundles is a central unit 348 which is constructed as either an active effective element or which can contain further active mechanisms of the already described type.

Figure 64:
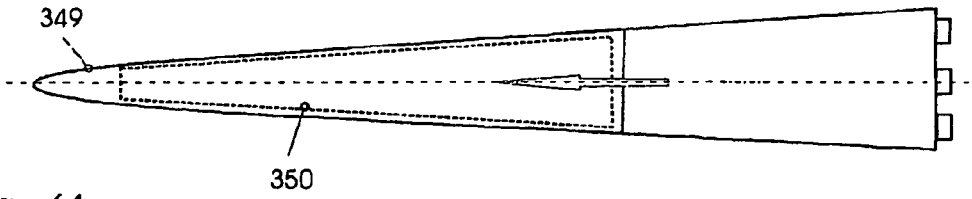
FIG. 64 illustrates a high velocity-underwater body with an active effective component.
Figure 65:
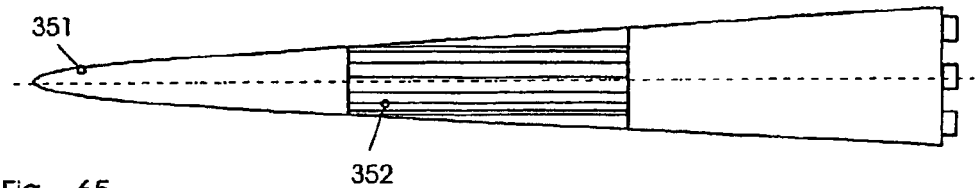
FIG. 65 illustrates an example of a high velocity-underwater body with an active effective body bundle.
Figure 66:
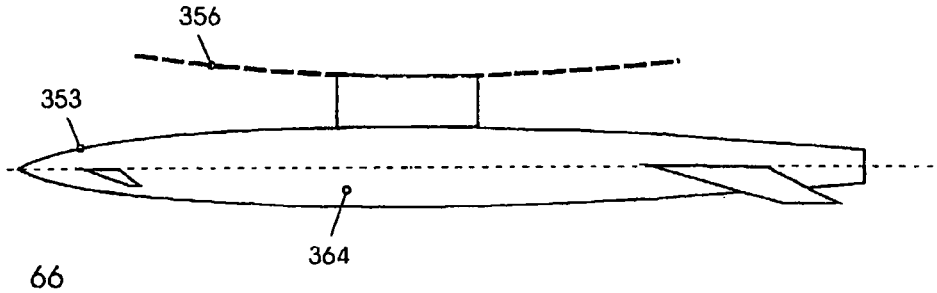
FIG. 66 illustrates an aircraft-supported airborne body, designed as an active effective unit.

In FIG. 64 there is represented a high speed-underwater body 349 with an active effective component 350. FIG. 65 illustrates, again in an intensely simplified schematic representation, an example for a high speed-underwater body 351 with an active effective body bundle 352.

Figure 67:
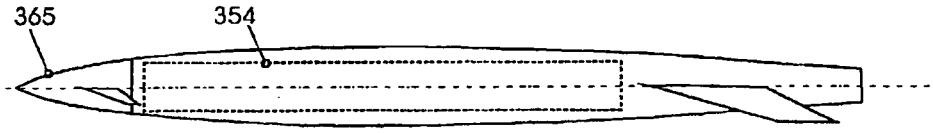
FIG. 67 illustrates an example of a self-flying airborne with an integrated active effective body.
Figure 68:
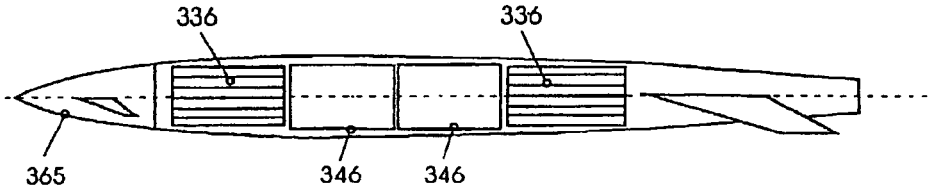
FIG. 68 illustrates an example of an airborne body with a plurality of active effective stages.
Figure 69:
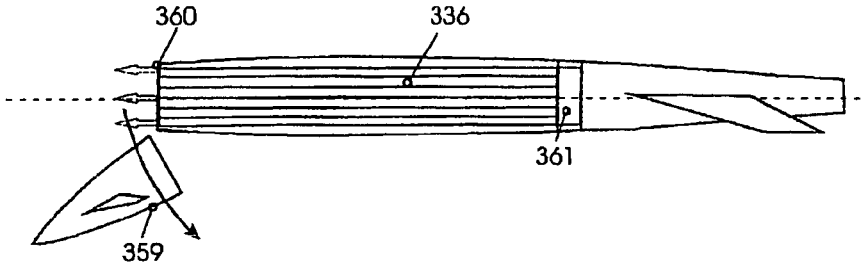
FIG. 69 illustrates an example of an ejection container with an active effective bundle.
Figure 70:
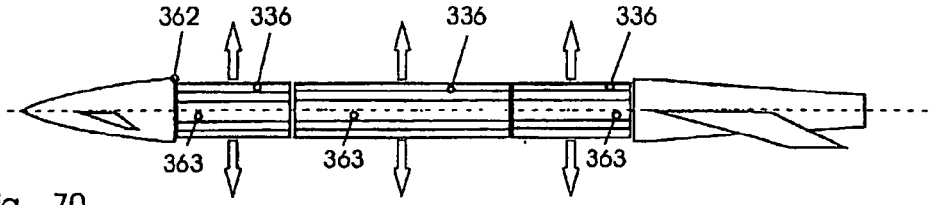
FIG. 70 illustrates an example of a dispenser with a plurality of active effective body stages.

FIGS. 66 through 70 illustrates aircraft supported or autonomously flying airborne bodies or ejection containers (dispensers) with one or more active effective bodies in accordance with the invention. Thus, in FIG. 66 there is illustrated an aircraft supported (356) airborne bodies 353 which is designed as an active effective unit 364. FIG. 67 illustrates an example for an autonomously flying airborne body with a search head 365 and with an integrated active effective body 354, and FIG. 68 an example for an airborne body 365 with a plurality of active effective stages 336 or respectively 346. FIG. 69 illustrates an example for dispensing 360 with an active effective body bundle 336 and an axially ejection arrangement 361. Hereby, for example, the hood 359 was previously expelled or removed otherwise such as mechanically or aeroballistically. FIG. 70 illustrates an example for a dispenser 362 with a plurality of active effective body stages 336 in which the active effective bodies are radially accelerated by means of a centrally positioned ejection unites 363.

Special advantage of the invention naturally resides also in the utilization as end phase guided ammunition (intelligent ammunition) in conjunction with an increase in the range of the artillery, which also should be connected with an increase in hitting probability.

Furthermore, it is conceivable, that for the generation of a fragment/subprojectile field at predetermined or specified distances in front of the weapon muzzle, for example, after completion of the burning of a light tracer, there is initiated the active projectile disintegration in conformance with the principle provided by this invention. In this manner, especially with weapons with a high cadence or firing rate, there can be achieved closely covered fragment/subprojectile fields. Furthermore, it is possible that the projectile casings be assembled from preformed subprojectiles which by means of a resistance stabilization will fly stabilized further along due to the aerodynamic forces, and thereby maintain such effective fields over a greater distance.

Collective details which are illustrated in the figures and explained in the specification are important to the invention. Hereby, it is a feature of the invention that all described details in a practical manner can be singly or multiply combined and resultingly thereby provide an active laterally effective penetrator which is individually correlated with all instances of use.

What is claimed is:

1. An active effective body comprising an effective body casing, a pressure-generating arrangement including one or a plurality of pressure-generating elements, and an activatable initiating device, further comprising an inert pressure-transmitting medium within the effective body casing which is a component of the active effective body being separate to the pressure-generating arrangement, wherein the inert pressure-transmitting medium and the pressure-generating arrangement are coupled to create a dynamic build up of a sweeping pressure field in the pressure-transmitting medium as to deform the effective body casing.

2. An active effective body according to claim 1, wherein the pressure-transmitting medium is entirely or at least partially constituted of a material which is selected from the group consisting of light metals or their alloys, plastically deformable metals or their alloys, duroplastic or thermoplastic synthetic materials, organic substances, elastomeric materials, glass-like or pulverous materials, pressed members of glass-like or pulverous materials, and mixtures of combinations thereof.

3. An active effective body according to claim 1, wherein the pressure-transmitting medium includes a portion consisting of a pyrophorous or other combustible material.

4. An active effective body according to claim 1, wherein the pressure-transmitting medium is pasty, gelatinous, gooey, a fluid or liquid.

5. An active effective body according to claim 1, wherein the pressure-transmitting medium is arranged so as to be variably located along the length of the active body or possesses different damping properties.

6. An active effective body according to claim 1, wherein the pressure-transmitting medium is assembled from two or more radially inwardly arranged elements which possess different material or selectively damping properties.

7. An active effective body according to claim 1, wherein an activatable triggering arrangement is initiatable by a time or approach signal during firing or respectively during the flying phase.

8. An active effective body according to claim 1, wherein the activatable triggering arrangement is activatable upon impact against a target structure, during penetration or subsequent to penetration through the target structure.

9. An active effective body according to claim 1, wherein the pressure-generating elements of the pressure-generating arrangement comprises selectively explosives fuses, explosive capsules, detonators or gas generators.

10. An active effective body according to claim 1, wherein there are provided a plurality of pressure-generating elements which are initiated either time-wise separately or simultaneously.

11. An active effective body according to claim 1, wherein there are provided auxiliary arrangements for the triggering of the pressure-generating elements which are formed as separate modules or which are embedded in the pressure-transmitting medium.

12. An active effective body according to claim 1, wherein the pressure-transmitting medium is either or entirely or partially constituted of prefabricated structures.

13. An active effective body according to claim 1, wherein embedded in the pressure-transmitting medium are entirely or partially rod shaped or successively connected end ballistic or the like effective similar or different bodies, whereby the bodies are arranged in the pressure-transmitting medium or are suitably distributed.

14. An active effective body according to claim 13, wherein the bodies which are embedded into the pressure-transmitting medium possess pyrophoric or explosive properties.

15. An active effective body according to claim 1, wherein the active body casing is constituted of a material which is selected from a group consisting of sintered, pure or brittle metals of high density, steel of high hardness, pressed powders, lightweight metals, plastics and fiber materials.

16. An active effective body according to claim 15, wherein the active body casing facilitates forming of statistically divided subprojectiles or fragments.

17. An active effective body according to claim 16, wherein the active body casing is constituted of one or more rings of segments, elongated structures or subprojectiles which are mechanically connected, glued or soldered to each other.

18. An active effective body according to claim 1, wherein the active body casing is either entirely or partially encompassed by a second casing.

19. An active effective body according to claim 1, wherein the active body casing possesses variable wall thicknesses along the length thereof.

20. An active effective body according to claim 1, wherein one or more penetrators, containers or similar active components are arranged in the pressure-transmitting medium.

21. An active effective body according to claim 20, wherein the penetrators, containers, or the like active components possess a specified surface and are solid, or entirely or partially possess a hollow space.

22. An active effective body according to claim 21, wherein the hollow spaces are filled entirely or partially with a pressure-transmitting medium or with reaction capable components.

23. An active effective body according to claim 20, wherein the active components are inert PELE penetrators or actively laterally effective penetrators.

24. An active effective body according to claim 1, wherein the active body is constituted of a plurality of individual modules consisting of tip modules, one or more sectional modules, and which are constructed as solid or inert laterally effective (PELE) or actively laterally effective (ALP), whereby the individual module is selectively exchangeable.

25. An active effective body according to claim 24, wherein the plurality of individual models are arranged about the circumference and/or length of the active body.

26. An active effective body according to claim 1, wherein the active body possesses a modules internal construction whereby auxiliary arrangements, the pressure-generating elements or the pressure-transmitting medium are insertable therein either exchangeably or at the instance of utilization.

27. An active effective body according to claim 1, wherein the active body is spin stabilized or aerodynamically stabilized or is fired with a compensating spin.

28. Rotationally stabilized or aerodynamically stabilized projectile with one or more active effective bodies according to claim 1.

29. End phase guided projectile with one or more active effective bodies according to claim 1.

30. Practice projectile with one or more active effective bodies according to claim 1.

31. Warhead with one or more active effective bodies according to claim 1.

32. Rocket-accelerated guided or unguided airborne body with one or more active effective bodies according to claim 1.

33. Guided or unguided underwater body in the form of a torpedo with one or more active effective bodies according to claim 1.

34. Aircraft supported or autonomously flying dispensing or ejection container in the form of a dispenser with one or more effective bodies according to claim 1.

35. An effective body according to claim 1, wherein the ratio of the mass of the pressure-generating unit relative to the total mass of the pressure-transmitting medium and the effective body casing is less than about 0.01.

36. A body capable of movement in a direction along a principle axis, comprising:

a pressure-generating arrangement including at least one pressure-generating element;

an inert pressure-transmitting medium situated with the pressure-generating arrangement, so that a pressure field sweeps and increases along the direction of the principle axis through the inert pressure-transmitting medium, wherein the at least one pressure-generating element initiates the pressure field; and an effective body casing surrounding the pressure generating arrangement and the inert pressure-transmitting medium.

37. The active effective body according to claim 1, wherein the ratio of the mass of the pressure-generating arrangement to the mass of the inert pressure-transmitting medium is less than about 0.5.

38. The body according to claim 36, wherein the pressure field within the inert pressure-transmitting medium deforms the effective body casing.

* * * * *